US008602328B2

(12) United States Patent
Adachi et al.

(10) Patent No.: US 8,602,328 B2
(45) Date of Patent: Dec. 10, 2013

(54) FUEL INJECTION DEVICE

(75) Inventors: Naofumi Adachi, Takahama (JP); Shuichi Matsumoto, Kariya (JP); Keisuke Suzuki, Okazaki (JP); Tomoyuki Tsuda, Mizuho (JP); Yoichi Kobane, Kuwana (JP); Yoshinori Okuno, Kariya (JP)

(73) Assignee: Denso Corporation, Kariya (JP)

( * ) Notice: Subject to any disclaimer, the term of this patent is extended or adjusted under 35 U.S.C. 154(b) by 420 days.

(21) Appl. No.: 12/791,954

(22) Filed: Jun. 2, 2010

(65) Prior Publication Data

US 2010/0301143 A1 Dec. 2, 2010

(30) Foreign Application Priority Data

Jun. 2, 2009 (JP) ..... 2009-133362
Feb. 15, 2010 (JP) ..... 2010-30544

(51) Int. Cl.
*F02M 43/00* (2006.01)

(52) U.S. Cl.
USPC ..... 239/533.3; 239/533.4; 239/533.5; 239/533.9

(58) Field of Classification Search
USPC ..... 239/533.3–533.9, 584, 533.2, 88–92, 239/585.3, 585.5
See application file for complete search history.

(56) References Cited

U.S. PATENT DOCUMENTS

| | | | | |
|---|---|---|---|---|
| 7,124,966 | B2 * | 10/2006 | Schlairet | 239/533.2 |
| 2003/0052198 | A1 | 3/2003 | Tappolet et al. | |
| 2009/0065614 | A1 * | 3/2009 | Ganser | 239/584 |
| 2012/0175435 | A1 | 7/2012 | Yamashita et al. | |

FOREIGN PATENT DOCUMENTS

| | | | | |
|---|---|---|---|---|
| DE | 0426205 | * | 8/1991 | F02M 47/02 |
| DE | 198 12 010 | | 9/1999 | |
| DE | 10 2006 036 843 | | 2/2007 | |
| EP | 0 426 205 | | 5/1991 | |
| JP | 2006-170169 | | 6/2006 | |
| JP | 2007-309191 | | 11/2007 | |
| WO | WO 2005/019637 | | 3/2005 | |
| WO | WO02005019637 | * | 3/2005 | F02M 47/02 |
| WO | WO2010/088781 | | 8/2010 | |

OTHER PUBLICATIONS

Extended European Search Report dated Jun. 11, 2012, issued in corresponding European Application No. 12163979.3-2311.

Extended European Search Report dated Jun. 11, 2012, issued in corresponding European Application No. 12163982.7-2311.

European Office Action dated Dec. 6, 2011, issued in corresponding European Application No. 10 005 693.6-2311.

(Continued)

*Primary Examiner* — Jason Boeckmann
*Assistant Examiner* — Joel Zhou
(74) *Attorney, Agent, or Firm* — Nixon & Vanderhye P.C.

(57) ABSTRACT

The invention has an object for improving response of a fuel injection device. A flow-in recessed portion and a flow-out recessed portion are formed at a press-contacting surface of a floating plate, which is movably accommodated in a pressure control chamber. A flow-in port and a flow-out port are formed at a pressure control surface of a valve body. The flow-in port is opened to the flow-in recessed portion, while the flow-out port is opened to the flow-out recessed portion. When the floating plate is moved upwardly and the press-contacting surface is brought into contact with the pressure control surface, the flow-in port is surely closed.

16 Claims, 19 Drawing Sheets

(56) References Cited

OTHER PUBLICATIONS

Extended European Search Report, issued in corresponding European Application No. 10005693.6-2311.
Japanese Office Action issued for Japanese Patent Application No. 2010-030544, dated May 28, 2013 (with English translation) 9 pages.
United States Office Action issued for U.S. Appl. No. 13/343,126, dated May 23, 2013.
European Search Report issued for corresponding European Patent Application No. 12163982.7-1606, dated Mar. 14, 2013.

* cited by examiner

FUEL INJECTION DEVICE

CROSS REFERENCE TO RELATED APPLICATION

This application is based on Japanese Patent Application No. 2009-133362 filed on Jun. 2, 2009 and Japanese Patent Application No. 2010-030544 filed on Feb. 15, 2010, the disclosures of which are incorporated herein by reference.

FIELD OF THE INVENTION

The present invention relates to a fuel injection device, according to which a valve portion is opened and closed in accordance with a control signal from an electronic control unit so that a part of fuel supplied from a fuel supply line to the fuel injection device is injected through injection ports and fuel injection is thereby controlled. According to the fuel injection device, a remaining part of the fuel is discharged to a fuel return line during the fuel injection operation.

BACKGROUND OF THE INVENTION

A fuel injection device is generally known in the art, which is composed of a control body having a pressure control chamber, and a valve member for opening and closing a valve portion in accordance with fuel pressure in the pressure control chamber. According to the fuel injection device of this kind, a fuel inlet port is opened to the pressure control chamber of the control body so that the fuel from the fuel supply line flows into the pressure control chamber, and a fuel outlet port is likewise opened to the pressure control chamber so that the fuel is discharged from the pressure control chamber to the fuel return line. Communication and non-communication (block-off of the communication) between the fuel outlet port and the fuel return line is controlled by a pressure control valve so that the fuel pressure in the pressure control chamber is controlled.

According to a known fuel injection device, for example, as disclosed in Japanese Patent Publication No. H6-108948 or Japanese Patent No. 4054621, the fuel injection device further has a floating member movable in the pressure control chamber. The floating member has a press-contacting surface, which is opposed in an axial direction of the floating member to a pressure control surface exposed to the pressure control chamber. A fuel inlet port as well as a fuel outlet port is opened at the pressure control surface. When a pressure control valve is operated to communicate the fuel outlet port with a fuel return line, the press-contacting surface of the floating member is attracted to the pressure control surface (at which the fuel outlet port is opened) by fuel flow from the pressure control chamber to the fuel outlet port. When the floating member is brought into contact with the pressure control surface, the press-contacting surface of the floating member is pressed against the pressure control surface, so that communication between the fuel inlet port and the pressure control chamber as well as communication between the fuel inlet port and the fuel outlet port is blocked off.

According to the fuel injection device of Japanese Patent No. 4054621, a surface portion of the pressure control surface (surrounding the fuel inlet port) is recessed, while another surface portion of the pressure control surface (surrounding the fuel outlet port) is not recessed but formed in a flat shape. The press-contacting surface of the floating member is also formed in a flat shape.

In the above fuel injection device, when the press-contacting surface of the floating member is pressed against the pressure control surface in order to block off the communication between the fuel injection port and the pressure control chamber, a surface area of the floating member (that is, the press-contacting surface) which is in contact with the pressure control surface is large. Therefore, it is difficult to increase surface pressure (pressing force per unit surface area). As a result, high pressure fuel from the fuel inlet port may pass through a gap between the pressure control surface and the press-contacting surface of the floating member. In other words, it is difficult to surely block off the communication between the fuel inlet port and the pressure control chamber. Therefore, when the fuel outlet port is opened (that is, when the fuel outlet port is communicated to the fuel return line), rapid pressure increase of the fuel in the pressure control chamber may not be realized, and thereby a rapid opening operation of the valve portion may not be possible.

SUMMARY OF THE INVENTION

The present invention is made in view of the above problems. It is an object of the present invention to provide a fuel injection device, in which a response for opening and closing a valve portion in accordance with a control signal from a control unit is increased.

According to a feature of the invention, a fuel injection device has a nozzle body having an injection port and movably accommodating a valve member. A valve portion is provided in the nozzle body for opening and closing the injection port by movement of the valve member in accordance with a control signal from an engine control unit, so that apart of high pressure fuel from a fuel supply system is injected from the injection port and another part of the fuel is discharged into a fuel discharge passage, which is operatively connected to a fuel return line.

The fuel injection device has a pressure control chamber having a flow-in port through which the high pressure fuel is supplied into the pressure control chamber, and a flow-out port through which the fuel is discharged from the pressure control chamber to the fuel discharge passage, wherein the fuel pressure in the pressure control chamber is applied to the valve member so that the valve member is moved up or down depending on the fuel pressure in the pressure control chamber to thereby open or close the injection port.

The fuel injection device has a control body having a valve body, wherein the valve body has a pressure control surface exposed to the pressure control chamber, and the flow-in port and the flow-out port are opened at the pressure control surface.

The fuel injection device has a pressure control valve provided in the fuel discharge passage for changing its valve position in accordance with the control signal, so that the flow-out port is communicated with the fuel return line or the communication between the flow-out port and the fuel return line is blocked off.

The fuel injection device has a floating member movably accommodated in the pressure control chamber and having a press-contacting surface opposing to the pressure control surface in a moving direction of the floating member, the press-contacting surface being pressed against the pressure control surface in order to block off communication between the flow-in port and the pressure control chamber as well as communication between the flow-in port and the flow-out port when the pressure control valve is operated to bring the flow-out port into communication with the fuel return line.

The fuel injection device has a flow-out recessed portion formed at the pressure control surface or the press-contacting surface, so that a first space is formed on the side of the press-contacting surface as a part of the pressure control chamber when the press-contacting surface of the floating member is in contact with the pressure control surface, wherein the flow-out port is opened to the flow-out recessed portion.

The fuel injection device has a flow-in recessed portion formed at the pressure control surface or the press-contacting surface, so that the flow-in recessed portion is isolated from the pressure control chamber when the press-contacting surface of the floating member is in contact with the pressure control surface, wherein the flow-in port is opened to the flow-in recessed portion.

According to another feature of the invention, the flow-in recessed portion is formed in an annular shape and coaxial with the pressure control surface or the press-contacting surface, at which the flow-in recessed portion is formed, and the flow-out recessed portion is formed at a surface portion of the pressure control surface or the press-contacting surface, at which the flow-out recessed portion is formed, the surface portion is located in an inside of flow-in recessed portion of the annular shape.

According to a further feature of the invention, the pressure control surface of the valve body is formed of a circular shape. The flow-out recessed portion is formed at the pressure control surface at a position offset from a center of the pressure control surface. The flow-out recessed portion is surrounded by an annular flow-out-side contacting portion. The flow-in recessed portion is formed at the pressure control surface. The flow-in recessed portion is surrounded by a part of the annular flow-out-side contacting portion and a part of an annular flow-in-side contacting portion. And the other part of the annular flow-out-side contacting portion and the other part of the annular flow-in-side contacting portion are overlapped with each other.

According to a still further feature of the invention, a second space is formed on the other side of the floating member opposite to the press-contacting surface, wherein the second space is another part of the pressure control chamber. The floating member has a communication hole for communicating the first and second spaces with each other, so that the flow-out port is communicated with the second space even when the press-contacting surface of the floating member is in contact with the pressure control surface, and the floating member has a restricted portion in the communication hole.

According to a still further feature of the invention, the control body has a cylinder, one end of which surrounds the pressure control surface, and a cylindrical space of which forms the pressure control chamber so that the floating member is movable in the cylindrical space. The press-contacting surface is moved away from the pressure control surface when the pressure control valve is operated to block off the communication between the flow-out port and the fuel return line.

A first space is formed on a side of the press-contacting surface of the floating member, as a part of the pressure control chamber, and a second space is formed on the other side of the floating member opposite to the press-contacting surface, as another part of the pressure control chamber.

A side wall portion is formed at an outer side wall of the floating member, and a communication passage is formed at the side wall portion for communicating the first and second spaces of the pressure control chamber with each other.

According to a still further feature of the invention, a fuel injection device has a nozzle body having an injection port and movably accommodating a valve member. A valve portion is provided in the nozzle body for opening and closing the injection port by movement of the valve member in accordance with a control signal from an engine control unit, so that a part of high pressure fuel from a fuel supply system is injected from the injection port and another part of the fuel is discharged into a fuel discharge passage, which is operatively connected to a fuel return line.

The fuel injection device has a pressure control chamber having a flow-in port through which the high pressure fuel is supplied into the pressure control chamber, and a flow-out port through which the fuel is discharged from the pressure control chamber to the fuel discharge passage.

The fuel injection device has a control body having a valve body and a cylinder, wherein the valve body has a pressure control surface surrounded by one end of the cylinder and exposed to the pressure control chamber, wherein the flow-in port and the flow-out port are opened at the pressure control surface, wherein one end of the valve member is movably supported in a cylindrical space of the cylinder, wherein the pressure control chamber is defined by the pressure control surface, an inner peripheral wall of the cylinder and a pressure receiving surface formed at one end of the valve member, and wherein the fuel pressure in the pressure control chamber is applied to the pressure receiving surface of the valve member so that the valve member is moved up or down depending on the fuel pressure in the pressure control chamber to thereby open or close the injection port.

The fuel injection device has a pressure control valve provided in the fuel discharge passage for changing its valve position in accordance with the control signal, so that the flow-out port is communicated with the fuel return line or the communication between the flow-out port and the fuel return line is blocked off.

The fuel injection device has a floating member movably accommodated in the pressure control chamber and having a press-contacting surface opposing to the pressure control surface in a moving direction of the floating member, wherein the press-contacting surface is pressed against the pressure control surface in order to block off communication between the flow-in port and the pressure control chamber as well as communication between the flow-in port and the flow-out port when the pressure control valve is operated to bring the flow-out port into communication with the fuel return line, and wherein the press-contacting surface is moved away from the pressure control surface when the pressure control valve is operated to block off the communication between the flow-out port and the fuel return line.

The fuel injection device has a first space formed on a side of the press-contacting surface of the floating member, as a part of the pressure control chamber, and a second space formed on the other side of the floating member opposite to the press-contacting surface, as another part of the pressure control chamber.

The fuel injection device has a side wall portion formed at an outer side wall of the floating member and a communication passage formed at the side wall portion for communicating the first and second spaces of the pressure control chamber with each other.

According to a still further feature of the invention, the side wall portion formed at the outer side wall of the floating member is in a sliding contact with the inner peripheral wall of the cylinder, so that the floating member is movable in the cylinder in its axial direction.

According to a still further feature of the invention, a passage area of the communication passage is larger than an opening area of the flow-in port.

According to a still further feature of the invention, multiple passage wall portions are formed at the side wall portion of the floating member, so that multiple communication passages are formed for communicating the first and second spaces of the pressure control chamber with each other.

According to a still further feature of the invention, the passage wall portion is formed of a flat surface extending in an axial direction of the floating member.

According to a still further feature of the invention, the passage wall portion is formed of a groove, one end of which is opened to the press-contacting surface of the floating member and the other end of which is opened to a side surface of the floating member opposite to the press-contacting surface.

According to a still further feature of the invention, a length of the groove in a circumferential direction of the floating member is made larger than a depth of the groove in a radial direction of the floating member.

According to a still further feature of the invention, the control body has a cylinder, one end of which surrounds the pressure control surface, and a cylindrical space of which forms the pressure control chamber so that the floating member is movable in the cylindrical space. The press-contacting surface is moved away from the pressure control surface when the pressure control valve is operated to block off the communication between the flow-out port and the fuel return line. A first space is formed on a side of the press-contacting surface of the floating member, as a part of the pressure control chamber, and a second space is formed on the other side of the floating member opposite to the press-contacting surface, as another part of the pressure control chamber. A side wall portion is formed at an outer side wall of the floating member, and a communication space is formed at a gap between the side wall portion and an inner peripheral wall of the cylinder for communicating the first and second spaces of the pressure control chamber with each other.

According to a still further feature of the invention, the floating member is formed in a disc shape and movable in the pressure control chamber in an axial direction of the disc shaped floating member, and a diameter of the floating member at the press-contacting surface or a surface of the floating member opposite to the press-contacting surface is made smaller than a diameter of the floating member at a middle portion thereof.

According to a still further feature of the invention, a side wall portion is formed at an outer side wall of the floating member, and the side wall portion has a cross sectional shape, which is outwardly expanded in a radial direction of the floating member.

According to a still further feature of the invention, a stopper portion is formed at an inner peripheral wall of the cylinder, so that a surface of the floating member opposite to the press-contacting surface is brought into contact with the stopper portion so as to limit a movement of the floating member. In addition, a flow limiting groove is formed at the stopper portion or at the surface of the floating member opposite to the press-contacting surface, so that the fuel may flow though the flow limiting groove.

BRIEF DESCRIPTION OF THE DRAWINGS

The above and other objects, features and advantages of the present invention will become more apparent from the following detailed description made with reference to the accompanying drawings. In the drawings:

FIGS. 5A and 5B are further enlarged cross sectional views showing the characterizing portion of the fuel injection device of the first embodiment, wherein FIG. 5A shows a condition in which a floating plate is in contact with a pressure control surface, and FIG. 5B shows another condition in which the floating plate is separated from the pressure control surface;

FIGS. 14A and 149 show a floating plate used in the fuel injection device of the third embodiment, wherein FIG. 14A is a plan view and FIG. 14B is a side view of the floating plate;

FIGS. 15A and 15B show a floating plate used in the fuel injection device of a fourth embodiment of the present invention, wherein FIG. 15A is a plan view and FIG. 15B is a side view of the floating plate;

FIGS. 16A and 16B show a floating plate used in the fuel injection device of a fifth embodiment of the present invention, wherein FIG. 16A is a plan view and FIG. 16B is a side view of the floating plate;

DETAILED DESCRIPTION OF THE PREFERRED EMBODIMENTS

Figure 1:
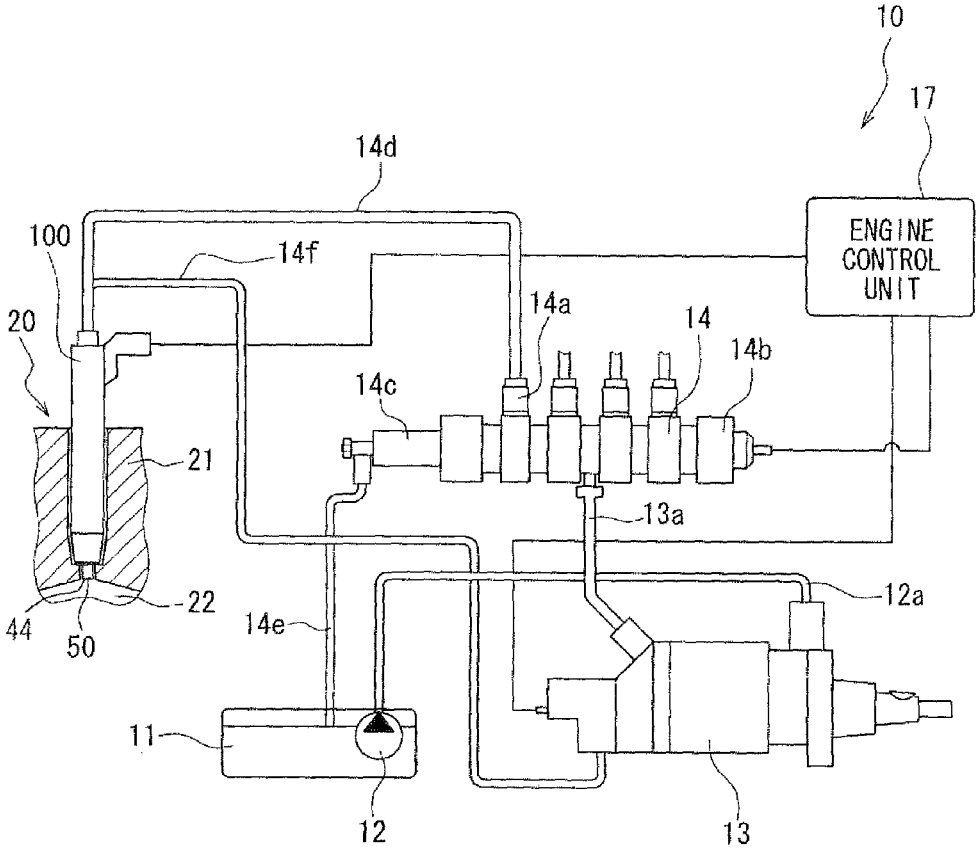
FIG. 1 is a schematic view showing a structure of a fuel supply system, in which a fuel injection device according to a first embodiment of the present invention is incorporated.

Embodiments of the present invention will be explained with reference to the drawings. The same reference numerals are used for the same or similar parts and components, so that duplicated explanation will be eliminated.

First Embodiment

FIG. 1 shows a fuel supply system 10, to which a fuel injection device 100 according to a first embodiment is applied. The fuel injection device 100 is a fuel injection valve of a direct injection type, which directly injects fuel into a combustion chamber 22 of a diesel engine 20 (an internal combustion engine).

The fuel supply system 10 is composed of a fuel feed pump 12, a high pressure pump 13, a common rail 14, an engine control unit 17, and the fuel injection device 100.

The fuel feed pump 12 is an electrically driven pump and mounted in a fuel tank 11. The fuel feed pump 12 applies a feed pressure to fuel contained in the fuel tank 11, wherein the feed pressure is higher than vapor pressure of the fuel. The fuel feed pump 12 is connected to the high pressure pump 13 via a fuel pipe 12*a* in order to supply the fuel in liquid phase (to which a certain feed pressure is applied) to the high pressure pump 13. A pressure regulating valve (not shown) is provided in the fuel pipe 12*a*, so that fuel pressure of the fuel to be supplied to the high pressure pump 13 is regulated at a predetermined pressure.

The high pressure pump 13 is mounted to the diesel engine 20, so that it is driven by a driving torque from an output shaft of the diesel engine. The high pressure pump 13 is connected to the common rail 14 via a fuel supply pipe 13*a* in order to further pressurized the fuel from the fuel feed pump 12 and to supply such high pressure fuel to the common rail 14. The high pressure pump 13 has an electromagnetic valve (not shown) electrically connected to the engine control unit 17. The electromagnetic valve is controlled by the engine control unit 17 to open and close, so that the fuel pressure of the fuel to be supplied from the high pressure pump 13 to the common rail 14 is controlled at a predetermined value.

The common rail 14 is formed in a pipe shape made of chrome molybdenum steel and a plurality of branch portions 14*a* is formed. A number of the branch portions 14*a* corresponds to a number of cylinders of the diesel engine 20. Each of the branch portions 14*a* is respectively connected to the fuel injection devices 100 via a fuel pipe forming a fuel supply line 14*d*. The fuel injection devices 100 as well as the high pressure pump 13 are connected to a fuel pipe forming a fuel return line 14*f*. According to the above structure, the common rail 14 temporarily stores the high pressure fuel supplied from the high pressure pump 13 and distributes the fuel to the respective fuel injection devices 100 via the fuel supply lines 14*d* while keeping the high fuel pressure.

The common rail 14 further has a common rail sensor 14*b* and a pressure regulator 14*c* at respective axial ends. The common rail sensor 14*b* is electrically connected to the engine control unit 17. The common rail sensor 14*b* detects pressure and temperature of the fuel and outputs detected information to the engine control unit 17. The pressure regulator 14*c* regulates the pressure of the fuel in the common rail 14 at a predetermined value and at the same time depressurizes and discharges surplus fuel. The surplus fuel passing through the pressure regulator 14*c* returns to the fuel tank 11 via a fuel line formed by a fuel pipe 14*e*, which connects the common rail 14 to the fuel tank 11.

The fuel injection device 100 injects the high pressure fuel from injection ports 44, wherein the high pressure fuel is supplied to the respective fuel injection devices 100 via the branch portions 14*a* of the common rail 14. The fuel injection device 100 opens and closes a valve portion 50 in accordance with a control signal from the engine control unit 17, so that fuel injection of the fuel supplied from the fuel supply line 14*d* and injected through the injection ports 44 is controlled. A part of the fuel, which has not been injected through the injection ports 44, is discharged into the fuel return line 14*f*. As above, the fuel injection is controlled by the fuel injection device 100. The fuel injection device 100 is inserted into and fixed to an injector hole formed in a cylinder head 21, which is a part of the diesel engine 20 forming the combustion chamber 22. The fuel injection devices 100 are arranged to the respective combustion chambers 22 so as to directly inject the fuel thereinto, for example, at a pressure of 160 to 220 MPa.

The engine control unit 17 is composed of a micro computer and so on, which is electrically connected not only to the above common rail sensor 14*b* but also to a rotational speed sensor for detecting a rotational speed of the diesel engine 20, a throttle sensor for detecting an opening degree of a throttle valve, an air flow sensor for detecting intake air amount, a pressure sensor for detecting a pressure of a super charger, a temperature sensor for detecting temperature of engine cooling water, an oil temperature sensor for detecting temperature of lubricating oil, and other various sensors. The engine control unit 17 outputs electrical signals to the electromagnetic valve of the high pressure pump 13 and the fuel injection devices 100 for controlling opening and closing operations thereof. The electrical signals are calculated based on the information of the sensors.

A structure of the fuel injection device 100 will be further explained in detail with reference to FIGS. 2 and 3.

The fuel injection device 100 is composed of a control valve driving portion 30, a control body 40, a nozzle needle 60, and a floating plate 70. Only for the purpose of explanation, a portion (or a side) of the fuel injection device 100, such as the valve portion 50 which is exposed into the combustion chamber 22, that is a lower portion of the fuel injection device 100 in the drawing of FIG. 2, is referred to as a forward end and/or a forward end side, while an opposite portion (or an opposite side) of the fuel injection device 100 is referred to as a top end and/or top end side.

The control valve driving portion 30 is accommodated in the control body 40. The control valve driving portion 30 has a terminal 32, a solenoid 31, a stator 36, a movable member 35, a spring 34, and a valve seat member 33. The terminal 32 is made of electrically conductive metal material, one end of which is outwardly projected from the control body 40 and the other end of which is connected to the solenoid 31. The solenoid 31 is a spirally would coil for receiving pulse-formed current from the engine control unit 17 via the terminal 32. The solenoid 31 generates magnetic field going around in an axial direction, when receiving the current. The stator 36 is made of magnetic material and formed in a cylindrical shape. The stator 36 is magnetized in the magnetic field generated by the solenoid 31. The movable member 35 is made of magnetic material and formed in a column shape having a step portion. The movable member 35 is arranged on the forward end side of the stator 36 (a lower side of the stator 36 in the drawing). The movable member 35 is attracted by the magnetized stator 36 in a direction toward the top end side of the fuel injection device 100 (in an upward direction in the drawing). The spring 34 is a coil spring made of a wire rod spirally wound and biases the movable member 35 in a direction away from the stator 36 (in a downward direction in the direction). The valve seat member 33 forms a pressure control valve 80 together with a valve seat 47*a* of the control body 40 (explained below). The valve seat member 33 is provided at a lower end of the movable member 35 (that is, an opposite end of the movable member 35 to the stator 36) and being capable of being seated on the valve seat 47*a*. When the magnetic field is not generated by the solenoid 31, the valve seat member 33 is seated on the valve seat 47*a* by the biasing force of the spring 34. When the magnetic field is generated by the solenoid 31, the valve seat member 33 is separated (lifted up) from the valve seat 47*a*.

Figure 2:
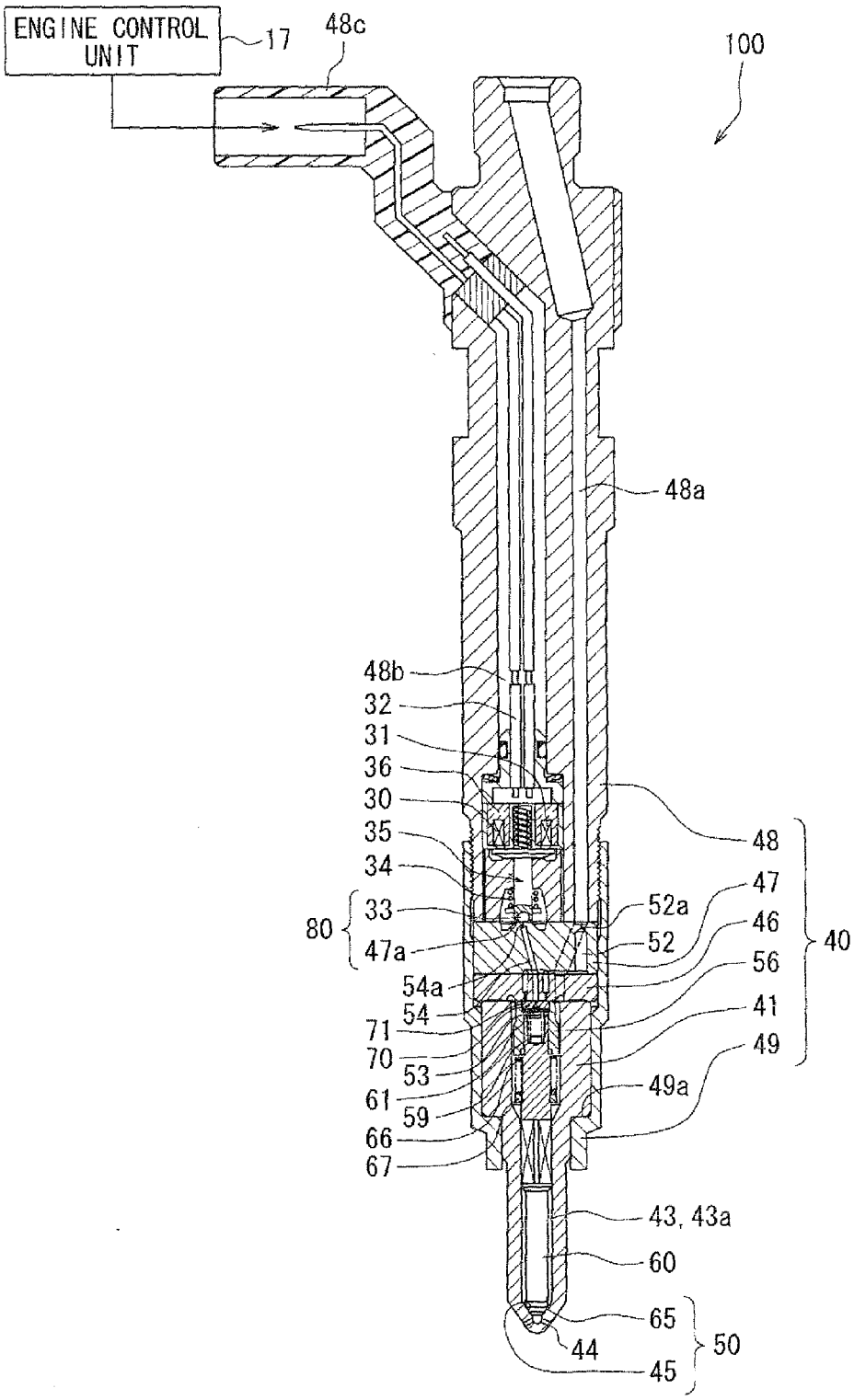
FIG. 2 is a longitudinal cross sectional view showing the fuel injection device of the first embodiment.
Figure 3:
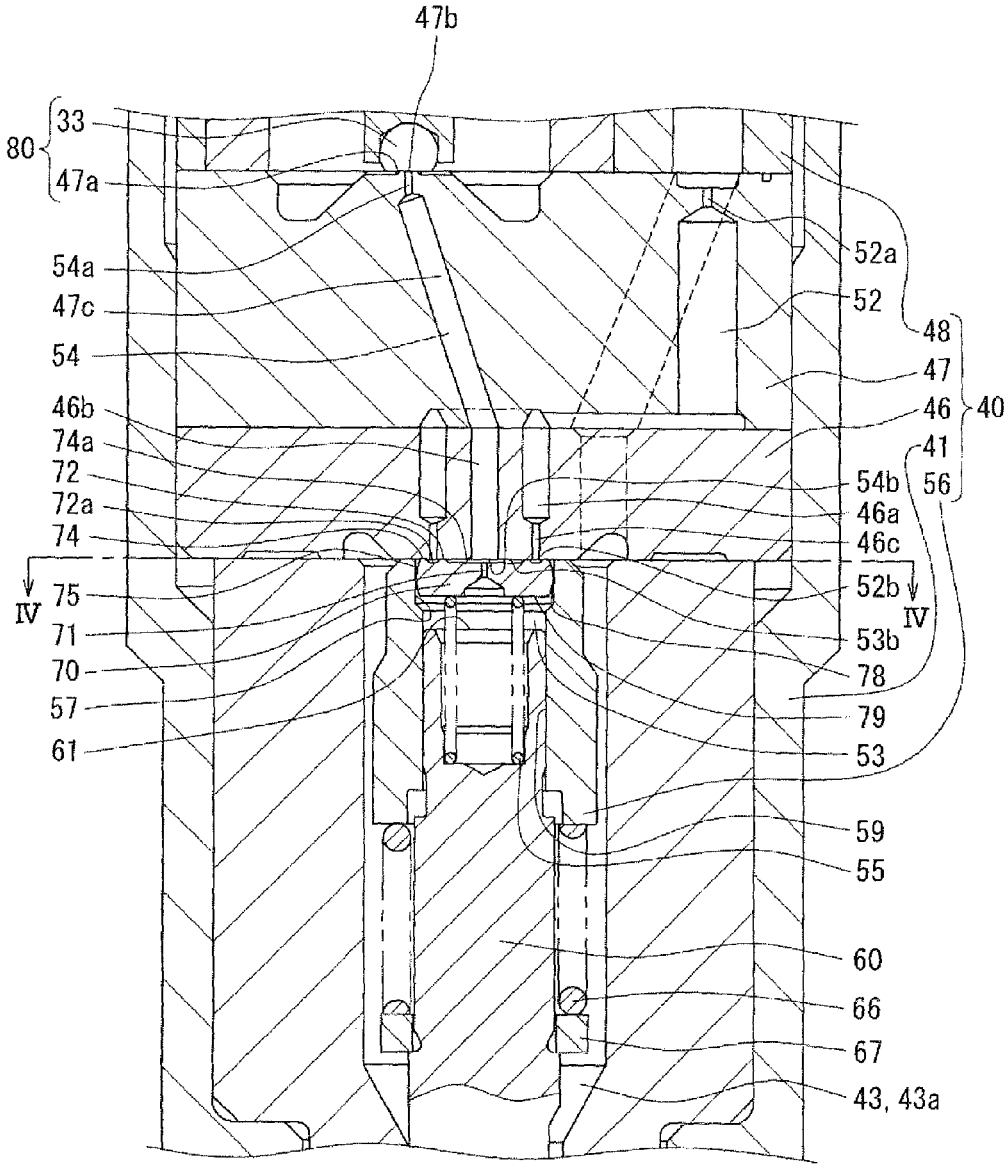
FIG. 3 is an enlarged cross sectional view showing a characterizing portion of the fuel injection device of the first embodiment.
Figure 5A:
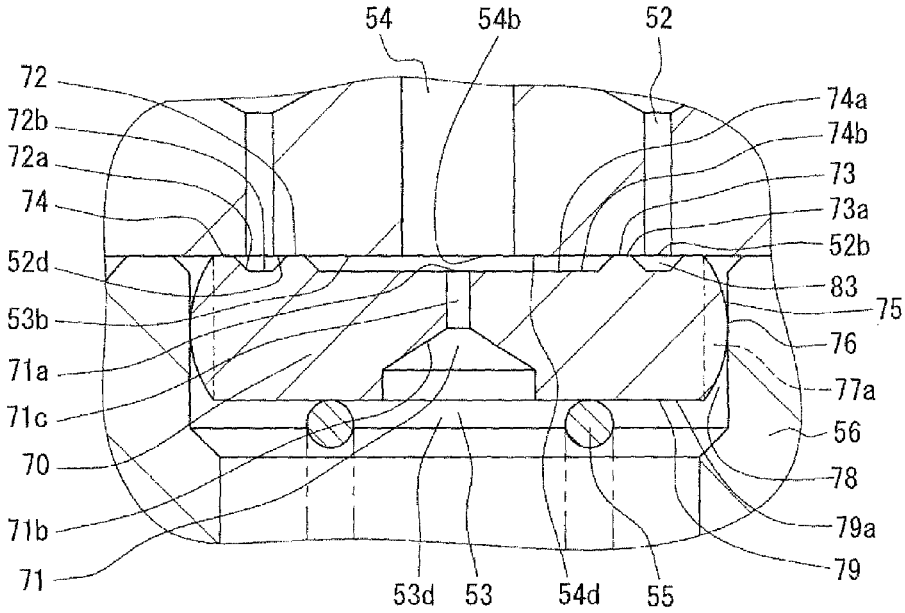
Figure 5B:
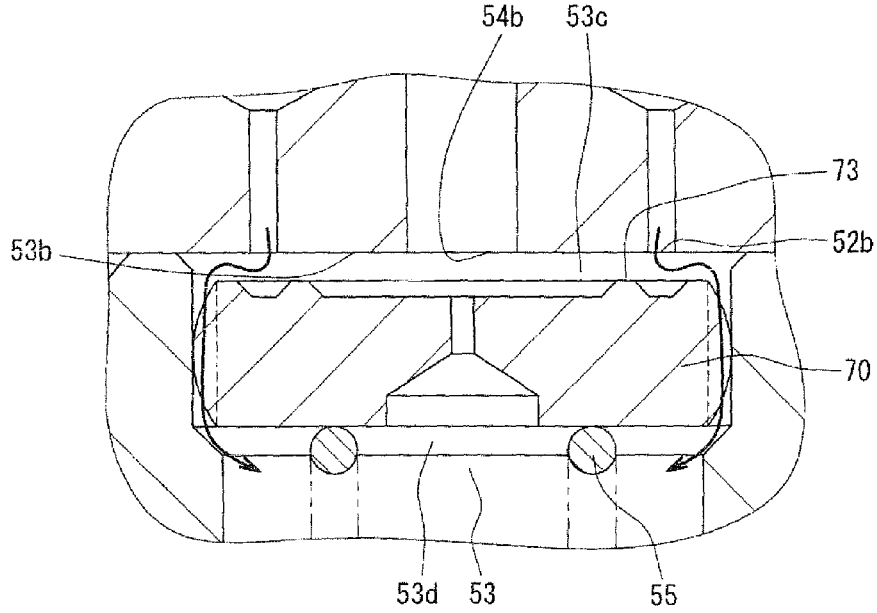

As more clearly shown in FIG. 3, and FIGS. 5A and 5B, the control body 40 has a nozzle body 41, a cylinder 56, a first valve body 46, a second valve body 47, a valve holder 48, and a retaining nut 49 (FIG. 2). A flow-in passage 52 which is communicated to the common rail 14 and the high pressure pump 13 via the fuel supply line 14*d*, a pressure control chamber 53 into which the fuel flows from the flow-in passage 52, and a flow-out passage 54 for discharging the fuel from the pressure control chamber 53, are respectively formed in the control body 40. Furthermore, a flow-in port 52*b* and a flow-out port 54*b*, each of which is opening to the pressure control chamber 53, are provided at a pressure control surface 53*b* of the first valve body 46. The pressure control surface 53*b* is a lower surface of the first valve body 46 and is exposed to the pressure control chamber 53 and facing to the floating plate 70 on the top end side. According to the above structure of the control body 40, the fuel from the fuel supply line 14*d* flows into the pressure control chamber 53 through the flow-in port 52*b* and the fuel is discharged to the fuel return line 14*f* through the flow-out port 54*b*.

As shown in FIG. 2, the nozzle body 41 is made of chrome molybdenum steel and is formed in a cylindrical shape having a closed bottom end. The nozzle body 41 has a nozzle-needle accommodating portion 43, a valve seat portion 45, and the injection ports 44. The nozzle-needle accommodating portion 43 is formed in a direction along an axial direction of the nozzle body 41 and a longitudinal hole is formed therein for accommodating the nozzle needle 60. The high pressure fuel from the high pressure pump 13 and the common rail 14 is supplied into the nozzle-needle accommodating portion 43. A fuel flow passage 43*a* is formed in the nozzle-needle accommodating portion 43, so that the fuel from the fuel supply line 14*d* flows to the injection ports 44. The valve seat portion 45 is formed at the closed bottom end of the nozzle body 41 (at the forward end of the nozzle-needle accommodating portion 43), on or from which a forward end of the nozzle needle 60 is seated or separated. The injection ports 44 are formed at the forward end of the nozzle body 41, which are located at a further forward side of the valve seat portion 45, and composed of multiple micro-holes extending in a radial pattern from the inside of the nozzle body 41 toward the outside thereof. When the fuel passes through the micro-holes, the fuel is atomized and diffused into the air so that the fuel is easily mixed with the air.

As more clearly shown in FIG. 3, the cylinder 56 is made of metal and formed in a cylindrical shape. The cylinder 56 is arranged within and co-axially with the nozzle-needle accommodating portion 43 and located on the forward end side (the lower side in the drawing) of the first valve body 46. The cylinder 56 surrounds the pressure control surface 53*b* to define the pressure control chamber 53. An inner peripheral wall 57 of the cylinder 56 forms the pressure control chamber 53 (which is a cylindrical space) together with a wall surface on the forward end side of the first valve body 46 (that is, the pressure control surface 53*b*). In addition, the inner peripheral wall of the cylinder 56 forms on the forward end side (the lower side in the drawing) a cylinder sliding portion 59 for movably supporting the nozzle needle 60, so that the nozzle needle 60 may reciprocate in the axial direction.

Each of the first and second valve bodies 46 and 47 is made of the metal, such as chrome molybdenum steel, and formed in a columnar shape. The second valve body 47 is held at the forward end side (the lower side in the drawing) of the valve holder 48 and holds the first valve body 46 at its forward end side. The first and second valve bodies 46 and 47 are interposed between the nozzle body 41 and the valve holder 48, and rotation of the first and second valve bodies 46 and 47 around a longitudinal axis of the fuel injection device 100 is restricted by the valve holder 48.

The flow-in passage 52 as well as a discharge passage 47*c* (which is a part of the flow-out passage 54) is formed in the first and second valve bodies 46 and 47. A flow-in side restricted portion 52*a* and a flow-out side restricted portion 54*a* are respectively formed in the flow-in passage 52 and the discharge passage 47*c*, each of which is formed in the second valve body 47, for restricting maximum flow amount in the respective passages. A valve seat portion 47*a* is formed on an upper side (the top end side) surface of the second valve body 47 so as to form the pressure control valve 80 together with the valve seat member 33 of the control valve driving portion 30 (FIG. 2). A discharge port 47*b* is opened at the valve seat portion 47*a*, which is formed on the upper side (the top end side) surface of the second valve body 47, so that the discharge port 47*b* is opened or closed by the pressure control valve 80. The pressure control valve 80 opens or closes the discharge port 47*b* in accordance with the control signal. The communication and non-communication between the flow-out port 54*b* and the fuel return line 14*d* is switched over from one condition to the other condition by opening or closing the discharge port 47*b*. The flow-out port 54*b* is opened at a lower end surface of the first valve body 46, wherein a part of the lower end surface forms the pressure control surface 53*b* and the flow-out port 54*b* is located at a center portion of the pressure control surface 53*b* in a radial direction. The fuel pressure in the pressure control chamber 53 is controlled by switching the communication and non-communication between the flow-out port 54*b* and the fuel return line 14*d*.

As shown in FIG. 2, the valve holder 48 is made of the metal, such as chrome molybdenum steel, and formed in a cylindrical shape. The valve holder 48 has longitudinal through-holes 48*a* and 48*b* which are formed along the axial direction of the fuel injection device 100. The valve holder 48 further has a socket portion 48*c*. The longitudinal through-hole 48*a* forms a part of the flow-in passage 52 and is communicated with the flow-in passage 52 formed in the second valve body 47. The other longitudinal through-hole 48*b* accommodates the control valve driving portion 30 at its forward end side (a lower end side). The socket portion 48*c* is formed at a top end side of the longitudinal through-hole 48*b* so as to close an open end thereof. One end of the terminal 32 of the control valve driving portion 30 projects in the inside of the socket portion 48*c*, into which a plug portion (not shown) connected to the engine control unit 17 will be inserted. It is possible to supply driving current from the engine control unit 17 to the control valve driving portion 30, when the plug portion (not shown) is electrically connected to the socket portion 48*c*.

The retaining nut 49 is made of metal material and formed in a cylindrical shape having a step portion 49*a*. The retaining nut 49 accommodates an upper portion of the nozzle body 41, the first valve body 46, and the second valve body 47. An upper end of the retaining nut 49 is screwed to a forward end (a lower end) of the valve holder 48. The step portion 49*a* is formed at an inner periphery of the retaining nut 49. The step portion 49*a* urges the nozzle body 41 and the first and second valve bodies 46 and 47 in a direction toward the valve holder 48, when the retaining nut 49 is screwed to the valve holder 48.

As shown in FIGS. 2 and 3, the nozzle needle 60 is made of a metal material, such as high-speed tool steel, and formed in a columnar shape. The nozzle needle 60 has a seat portion 65, a pressure receiving surface 61, and a ring member 67. The seat portion 65 is formed at a forward end (lower end) of the nozzle needle 60 and will be seated on or separated from the valve seat portion 45 of the nozzle body 41. The seat portion 65 forms the valve portion 50 together with the valve seat portion 45, wherein the communication and non-communication between the injection ports 44 and the fuel passage formed in the nozzle-needle accommodating portion 43 for the high pressure fuel are switched over by the valve portion 50.

The pressure receiving surface 61 is formed at a top end (an upper end) surface of the nozzle needle 60. The pressure receiving surface 61 is exposed to the pressure control chamber 53, so that the pressure receiving surface 61 receives the fuel pressure in the pressure control chamber 53. The ring member 67 is arranged at an outer peripheral wall of the nozzle needle 60 and is held by the nozzle needle 60. As above, the pressure control chamber 53 is defined by the inner peripheral wall 57 of the cylinder 56, the pressure control surface 53*b* of the first valve body 46, and the pressure receiving surface 61. The pressure control chamber 53 is separated from the fuel flow passage 43*a*.

The nozzle needle 60 is biased by a return spring 66 in a downward direction toward the valve portion 50. The return spring 66 is a coil spring made of metal wire spirally wound, a lower end of which is seated on an upper end surface of the ring member 67 and an upper end of which is in contact with a lower end surface of the cylinder 56. According to the above structure, the nozzle needle 60 is linearly moved with respect to the control body 40 in accordance with the fuel pressure in the pressure control chamber 53, to thereby open or close the valve portion 50.

As more clearly shown in FIGS. 5A and 5B, the floating plate 70 is a disc shaped member made of metal material and has a communication hole 71. The floating plate 70 is coaxially accommodated in the cylinder 56, so that the floating plate 70 is movable in an axial direction thereof, which is along a reciprocating direction of the nozzle needle 60. The floating plate 70 has a pair of axial end surfaces, one of which is an upper end surface 73*a* opposing to the pressure control surface 53*b* and forming a press-contacting surface 73, and the other of which is a lower end surface 79*a* forming a pressure receiving surface for receiving the fuel pressure in the pressure control chamber 53.

The floating plate 70 is pressed against the pressure control surface 53*b* by the fuel pressure in the pressure control chamber 53, when the pressure control valve 80 is switched to the communication state between the flow-out port 54*b* and the fuel return line 14*f*. Namely, the press-contacting surface 73 of the floating plate 70 is pressed against the pressure control surface 53*b* to block off the communication between the flow-in passage 52 and the pressure control chamber 53. The communication hole 71 is formed in the floating plate 70 at a center thereof in the axial direction. When the flow-in port 52*b* is closed by the floating plate 70, the fuel in the pressure control chamber 53 is discharged into the flow-out passage 54 through the communication hole 71. A flow passage area of the communication hole 71 is larger than that of the flow-out side restricted portion 54*a* (FIG. 3). When the pressure control valve 80 is switched to the non-communication state between the flow-out port 54*b* and the fuel return line 14*f*, the floating plate 70 is urged by the fuel pressure in the flow-in passage 52 in the direction away from the pressure control surface 53*b*. As a result, the press-contacting surface 73 of the floating plate 70 is moved away from the pressure control surface 53*b*, so that the flow-in passage 52 and the pressure control chamber 53 are brought into the communication state again.

(Characterizing Portions)

Characterizing portions of the fuel injection device 100 will be further explained with reference to FIGS. 3 to 6.

Figure 4:
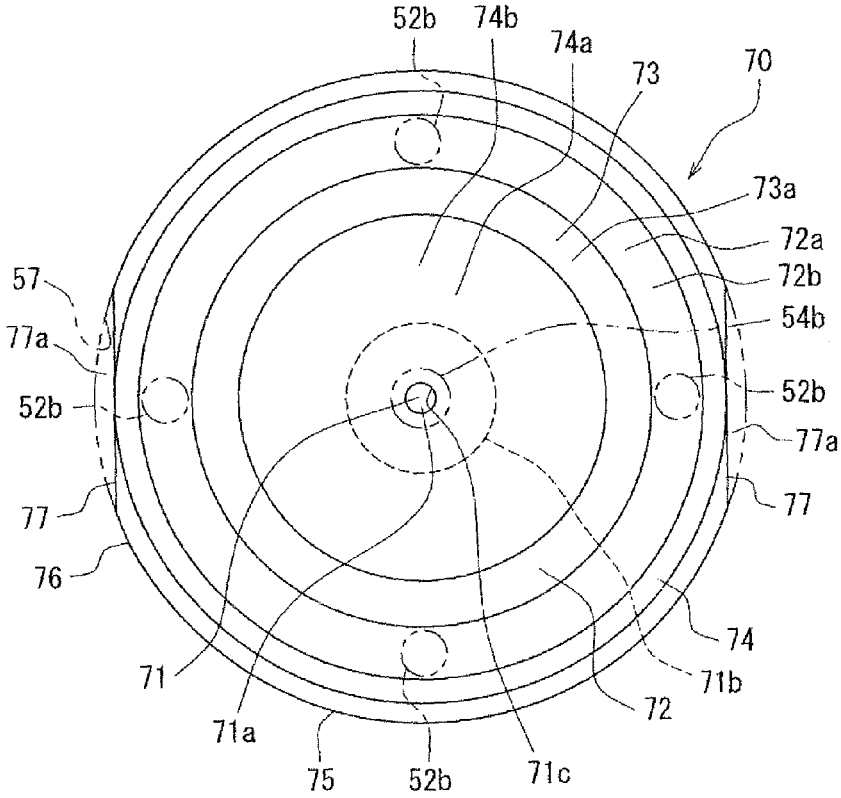
FIG. 4 is a cross sectional view taken along a line IV-IV in FIG. 3 showing an upper surface (that is, a press-contacting surface) of a floating plate.

As best shown in FIG. 3, longitudinal through-holes 46*a* and 46*b* are respectively formed in the first valve body 46 of the control body 40 in the axial direction. The through-hole 46*b* is a part of the discharge passage 47*c* and its lower end (that is, the flow-out port 54*b*) is opened to the pressure control chamber 53 in the direction to the communication hole 71 of the floating plate 70. The through-holes 46*a* form a part of the flow-in passage 52 and four through-holes 46*a* are formed around the through-hole 46*b* at equal distances in a circumferential direction (as shown in FIG. 4). A restricted portion 46*c* having a smaller passage area is formed at a lower side of each through-hole 46*a* (at a side closer to the pressure control chamber 53). A lower end of the each restricted portion 46*c*, that is, the flow-in port 52*b*, is restricted and opened to the pressure control chamber 53. A sum of the passage areas of the four restricted portions 46*c* is larger than the passage area of the flow-in side restricted portion 52*a*. As above, the flow-in ports 52*b* and the flow-out port 54*b* are formed in the first valve body 46 on the same surface opposing to the floating plate 70, and symmetrically arranged with respect to the axis of the floating plate 70 for its reciprocal movement (FIG. 4).

According to the above structure for the through-holes 46*a* and 46*b*, the flow-out port 54*b* is formed at the pressure control surface 53*b* in a center of the radial direction (as shown in FIG. 4). The flow-in ports 52*b* are formed at the pressure control surface 53*b* on an outer periphery side of the flow-out port 54*b* and arranged at the equal distances in the circumferential direction. As shown in FIG. 5A, a surface portion of the pressure control surface 53*b*, which surrounds the flow-in port 52*b*, is referred to as a flow-in-port surrounding portion. In a similar manner, a surface portion of the pressure control surface 53*b*, which surrounds the flow-out port 54*b*, is referred to as a flow-out-port surrounding portion.

As shown in FIG. 3, a passage portion of the discharge passage 47*c*, which is formed in the second valve body 47 and connects the flow-out port 54*b* and the discharge port 47*b* with each other, is inclined with respect to the axis of the second valve body 47. It is possible to freely design a position of the discharge port 47*b* as well as a position of the valve seat portion 47*a*, which are formed at the upper surface of the second valve body 47, when an inclination angle of the discharge passage 47*c* is changed with respect to the axial direction of the second valve body 47. This is possible even when the flow-out port 54*b* is formed at the center of the pressure control surface 53*b* of the first valve body 46. It is, therefore, possible to locate the pressure control valve 80 (that is, to decide a position of the discharge port 47*b*) at such a position, at which the pressure control valve 80 can surely operate. According to the above structure, the pressure control valve 80 can surely open and close the discharge port 47*b* in accordance with the control signal. In other words, the switching operation for the communication and non-communication between the flow-out port 54*b* and the fuel return line 14*f*, which is done by opening or closing the discharge port 47*b*, can be surely performed.

As shown in FIGS. 4 and 5A, the floating plate 70 further has a flow-in recessed portion 72*a*, a flow-out recessed portion 74*a*, an inner press-contacting portion 72, an outer press-contacting portion 74, a side wall portion 76 and a communication passage wall portion 77.

The flow-in recessed portion 72*a* is formed by depressing a part of the press-contacting surface 73, so that a bottom surface 72*b* is opposed to the flow-in-port surrounding portion 52*d* of the open-side wall surface 53*b* in the axial direction of the floating portion 70. The flow-in recessed surface 72*b* is recessed in the direction away from the pressure control surface 53*b*, to thereby form the annular flow-in recessed portion 72*a* at an outer side of the flow-out recessed portion 74*a*. The flow-in recessed portion 72*a* forms a flow-in space 83 together with the flow-in-port surrounding portion 52*d*, when the press-contacting surface 73 is in contact with the pressure control surface 53*b*, wherein the fuel flows into the flow-in space 83 from the plurality of the flow-in ports 52*b*.

The flow-out recessed portion 74*a* is formed by depressing a part of the press-contacting surface 73, so that a bottom surface 74*b* is opposed to the flow-out-port surrounding portion 54*d* of the pressure control surface 53*b* in the axial direction of the floating portion 70. The flow-out recessed surface 74*b* is recessed in the direction away from the pressure control surface 53*b*, to thereby form the circular flow-out recessed portion 74*a*. The flow-out recessed portion 74*a* is formed in a center of the press-contacting surface 73, so that the flow-out recessed portion 74*a* is coaxial with the circular press-contacting surface 73 and the annular flow-in recessed portion 72*a*, as shown in FIG. 4.

Each of the inner and the outer press-contacting portions 72 and 74 is formed in a circular shape on the upper end surface 73*a* of the floating plate 70. In other words, the inner and outer press-contacting portions 72 and 74 are coaxially formed on the press-contacting surface 73 and opposed to the pressure control surface 53*b*. The outer press-contacting portion 74 is formed at an outer peripheral portion of the floating plate 70 and surrounds the outer periphery of the circular flow-in recessed portion 72*a*. The inner press-contacting portion 72 is formed inside of the outer press-contacting portion 74 to define the flow-in and the flow-out recessed portions 72*a* and 74*a*. As above, each of inner and the outer press-contacting portions 72 and 74 is a circular projection formed on the upper end surface 73*a* (that is, the press-contacting surface 73) of the floating plate 70 projecting toward the pressure control surface 53*b*.

Since the flow-in recessed portion 72*a* is formed between the inner and outer press-contacting portions 72 and 74, the fuel pressure of the fuel flowing from the flow-in port 52*b* into the flow-in space 83 is applied to the flow-in recessed portion 72*a*, when the press-contacting surface 73 is pressed against and in contact with the pressure control surface 53*b*. Likewise, since the flow-out recessed portion 74*a* is surrounded by the inner press-contacting portion 72, the fuel pressure of the fuel in the flow-out passage 54 is applied to the flow-out recessed portion 74*a*, when the press-contacting surface 73 is pressed against and in contact with the pressure control surface 53*b*.

The side wall portion 76 and the passage wall portion 77 are formed at an outer side wall 75 of the floating plate 70. A longitudinal cross sectional shape of the outer side wall 75, which is a cross sectional shape on a plane including the axis of the floating plate 70, has a curved side wall projecting in a radial outward direction of the floating plate 70. A small communication space 78, through which the fuel flows, is formed between the side wall portion 76 of the outer side wall 75 and the inner peripheral surface 57 of the cylinder 56. The communication space 78 communicates an upper side space 53*c* and a lower side space 53*d* of the pressure control chamber 53 with each other. The upper side space 53*c* is a part of the pressure control chamber 53, which is formed between the floating plate 70 and the pressure control surface 53*b*. The lower side space 53*d* is another part of the pressure control chamber 53, which is formed between the floating plate 70 and the nozzle needle 60.

The passage wall portion 77 is formed by cutting away a part of the outer side wall 75. The passage wall portion 77 forms a communication passage 77*a* together with the inner peripheral wall 57, so that the upper side and lower side spaces 53*c* and 53*d* are communicated with each other. The passage wall portion 77 is formed as a flat surface. A pair of flat surface portions (the passage wall portions 77) is formed at opposite sides of the floating plate 70 in the radial direction. As above, in the present embodiment, the upper side and the lower side spaces 53*c* and 53*d* are communicated with each other not only through the communication passages 77*a* but also through the communication space 78.

A sum of the passage areas of the communication passages 77*a* and the communication space 78 is larger than a sum of the passage areas of the flow-in ports 52*b*. In addition, the sum of the passage areas of the communication passages 77*a* and the communication space 78 is larger than the passage area of the flow-in side restricted portion 52*a*. The passage area of the flow-in side restricted portion 52*a* is the smallest portion in the flow-in passage 52. According to the above structure, restoration of the fuel pressure in the lower side space 53*d* is not limited by the floating plate 70. Since the communication passages 77*a* and the communication space 78 are formed between the outer side wall 75 (the side wall portion 76 and the passage wall portion 77) of the floating plate 70 and the inner peripheral wall 57 of the cylinder 56, sufficient amount of the passage area can be obtained at the communication passages 77*a* and the communication space 78, without making the diameter of the floating plate 70 larger or making the area of the pressure receiving surface 79 smaller. As a result, the surface area of the pressure receiving surface 79 (the lower side surface of the floating plate 70) can be made larger than the surface area of the pressure receiving surface 61 of the nozzle needle 60 (the upper side surface thereof), so that a larger fuel pressure can be applied to the floating plate 70 from the fuel in the pressure control chamber 53. Accordingly, a response of the floating plate 70 to the pressure control valve 80 can be increased.

Since the passage wall portion 77 is formed by the flat surface, which is extending in a direction in parallel to the axial direction (the reciprocating direction) of the floating plate 70, the passage area of the communication passages 77*a* is maintained at a constant value irrespectively of the displaced position of the floating plate 70. Therefore, the fuel can surely flow from the upper side space 53*c* to the lower side space 53*d*, to quickly increase the fuel pressure in the lower side space 53*d*. As a result, a response of the nozzle needle 60 to the pressure control valve 80 can be also improved.

Since the communication hole 71 is formed at the center of the floating plate 70, the communication hole 71 communicates the pressure control chamber 53 (the lower side space 53*d* thereof) with the flow-out port 54*b*, when the floating plate 70 is pressed against and in contact with the pressure control surface 53*b*. An upper side opening port 71*a* of the communication hole 71 is formed at the flow-out recessed portion 74*a*, which is surrounded by the inner press-contacting portion 72, and located at the center of the press-contacting surface 73. The upper side opening port 71*a* is axially opposed to the flow-out port 54*b*. A lower side opening port (opposite to the upper side opening port 71*a*) is formed at a center of the pressure receiving surface 79 of the floating plate 70.

The communication hole 71 has a restricted portion 71*c* and a recessed portion 71*b*. The restricted portion 71*c* restricts the passage area of the communication hole 71, to thereby regulate flow amount of the fuel flowing through the restricted portion 71*c*. The restricted portion 71*c* is formed in the communication hole 71 on a side closer to the upper end surface 73*a* of the floating plate 70 (away from the lower end surface 79*a*). The lower side opening port of the communication hole 71 is made larger than the upper side opening port 71*a*. A lower part of the communication hole 71 is recessed (cut away) to form the lower side opening port.

A spring 55 is arranged between the nozzle needle 60 and the floating plate 70 for biasing the floating plate 70 toward the pressure control surface 53*b*, as shown in FIG. 3. The spring 55 is a coil spring made of a wire rod spirally wound, one axial end (a lower end) of which is seated on the nozzle needle 60 and the other end (an upper end) of which is in contact with the lower end surface 79*a* of the floating plate 70. The floating plate 70 is biased by the spring force of the spring 55 in the direction to the flow-in ports 52*b* so that the press-contacting surface 73 of the floating plate 70 is kept in contact with the pressure control surface 53*b*, even when no pressure difference is generated between the upper side space 53*c* and the lower side space 53*d*.

When the communication between the flow-out port 54*b* and the fuel return line 14*f* is blocked off by the pressure control valve 80, the floating plate 70 is moved away from the pressure control surface 53*b* by the fuel pressure in the flow-in space 83 against the spring force of the spring 55, as shown in FIG. 5B. The floating plate 70 is kept away from the pressure control surface 53*b*, until the fuel pressure in the upper side space 53*c* becomes balanced with the fuel pressure in the lower side space 53*d*.

An operation of the above explained fuel injection device 100, in which the valve portion 50 is opened and closed depending on the driving current from the engine control unit 17 to thereby inject the fuel, will be explained with reference to FIG. 6 together with FIGS. 2 to 5.

Figure 6:
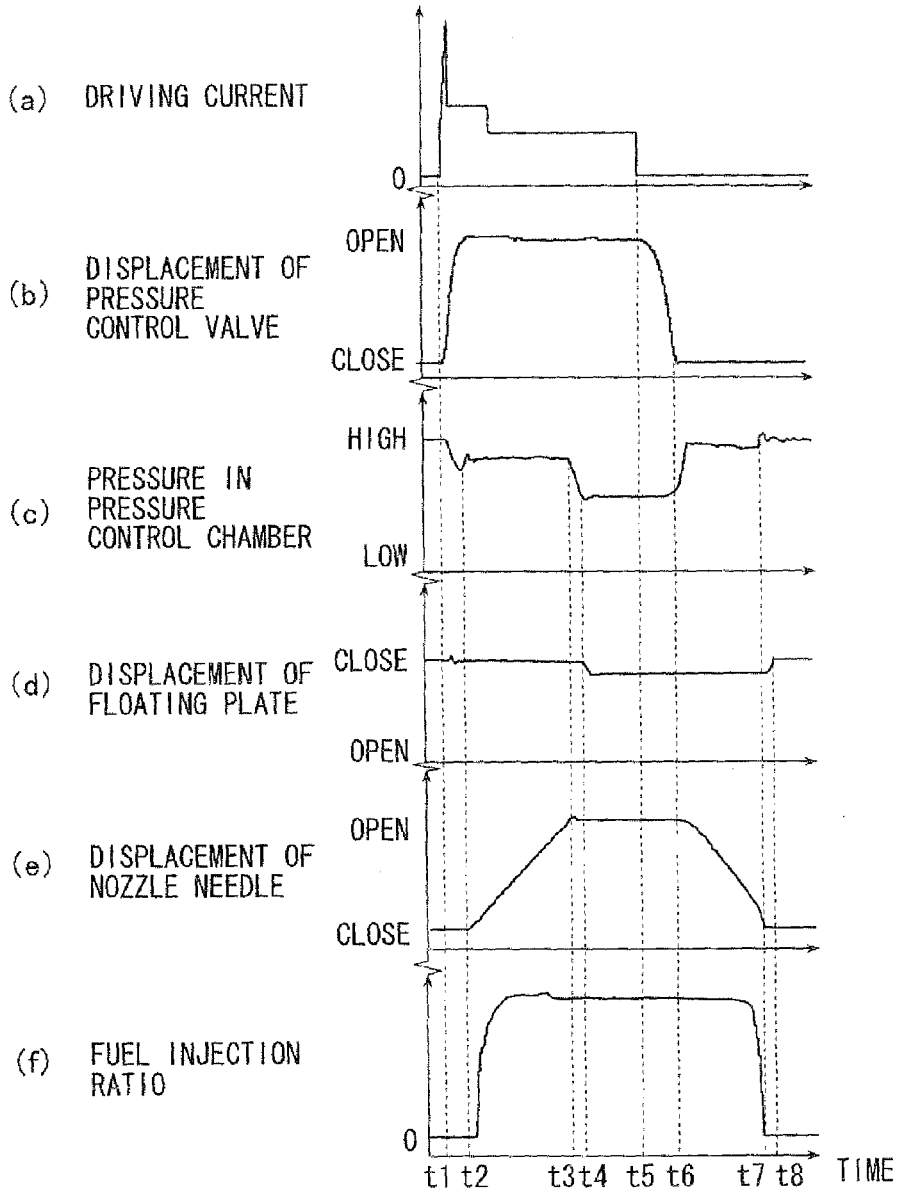
FIG. 6 is a chart showing operation of the fuel injection device of the first embodiment.

When driving current of a pulse shape is supplied from the engine control unit 17 to the solenoid 31 at a timing t1 (as shown in (a) of FIG. 6), the magnetic field is generated to operate the pressure control valve 80 so as to open the valve. When the pressure control valve 80 is opened, the fuel starts to flow out from the discharge passage 47*c* which is brought into the communication with the fuel return line 14*f*. The fuel pressure in the pressure control chamber 53 is decreased at first in an area neighboring to the flow-out port 54*b*. Then, the floating plate 70, which is biased by the spring 55 to the pressure control surface 53*b*, will be further pushed toward the pressure control surface 53*b*, so that the inner and the outer press-contacting portions 72 and 74 are pushed to the pressure control surface 53*b*. As a result, the communication between the flow-in ports 52 and the pressure control chamber 53 as well as the communication between the flow-in ports 52 and the flow-out port 54*b* are blocked off (that is, the blocked-off condition is maintained).

The fuel in the lower side space 53*d* of the pressure control chamber 53 flows out into the flow-out passage 54 through the communication hole 71 of the floating plate 70. Since the communication between the pressure control chamber 53 and the flow-in passage 52 is blocked off, the fuel pressure of the pressure control chamber 53 is rapidly decreased. As a result, a sum of the fuel pressure to the pressure receiving surface 61 of the nozzle needle 60 and the biasing force of the return spring 66 will become smaller than the nozzle needle lifting force which is applied by the fuel in the nozzle needle accommodating portion 43 to the seat portion 65 of the nozzle needle 60. Therefore, the nozzle needle 60 starts to move up at a high speed in the direction to the pressure control chamber 53, at a timing t2 (as shown in (e) of FIG. 6). During upward movement of the nozzle needle 60, the fuel pressure in the pressure control chamber 53 is maintained at almost a constant value, as shown in (c) of FIG. 6.

When the upward movement of the nozzle needle 60 to the pressure control chamber 53 is terminated, the fuel pressure in the pressure control chamber 53 starts again to further decrease at a timing t3 (as shown in (c) of FIG. 6). Then, the fuel pressure in the pressure control chamber 53 (in particular, in the lower side space 53*d*) is coming closer to the fuel pressure in the area neighboring to the flow-out port 54*b* (which is the fuel pressure in the flow-out recessed portion 74*a* of the floating plate 70). The biasing force for biasing the floating plate 70 in the upward direction is decreased. And a difference between the fuel pressure in the flow-in recessed portion 72*a* neighboring to the flow-in ports 52*b* and the fuel pressure in the pressure control chamber 53 becomes larger. Therefore, the floating plate 70 is moved in the downward direction by the fuel pressure in the flow-in recessed portion 72*a* against the biasing force of the spring 55, at a timing t4 (as shown in (d) of FIG. 6).

When the floating plate 70 is moved down, the pressure control chamber 53 is communicated with the flow-in passage 52 again, so that the high pressure fuel flows into the pressure control chamber 53. As a result, a further decrease of the fuel pressure in the pressure control chamber 53 is terminated, as shown in (c) of FIG. 6. The fuel, which flows into the upper side space 53*c*, passes through a space between the press-contacting surface 73 of the floating plate 70 and the pressure control surface 53*b*. An area, which is calculated by multiplying a length of the outer press-contacting portion 74 in its circumferential direction by a height of the displacement of the floating plate 70, is regarded as a passage area of the passage formed between the floating plate 70 and the first valve body 46. It is, therefore, desirable for the floating plate 70 to move down by a distance, so that the passage area between the floating plate 70 and the first valve body 46 would be larger than the passage area of the flow-in side restricted portion 52*a*.

When the supply of the driving current from the engine control unit 17 to the solenoid 31 is terminated, the pressure control valve 80 starts to close, at a timing t5 as shown in (b) of FIG. 6. When the pressure control valve 80 is closed at a timing t6 of FIG. 6, the flow-out of the fuel through the flow-out port 54*b* is stopped. The floating plate 70 is pushed down by the fuel pressure in the flow-in recessed portion 72*a* and kept at the position away from the pressure control surface 53*b*. Since the pressure control chamber 53 is in communication with the flow-in ports 52*b*, the fuel pressure in the pressure control chamber 53 is increased, as shown in (c) of FIG. 6. Then, the sum of the fuel pressure to the pressure receiving surface 61 of the nozzle needle 60 and the biasing force of the return spring 66 will become larger than the nozzle needle lifting force which is applied by the fuel in the nozzle needle accommodating portion 43 to the seat portion 65 of the nozzle needle 60. The nozzle needle 60 is thereby moved down at a high speed in the direction to the valve portion 50, so that the seat portion 65 of the nozzle needle 60 is seated on the valve seat portion 45 to close the valve portion 50, at a timing t7 as shown in (e) of FIG. 6.

When the downward movement of the nozzle needle 60 is ended (at the timing t7), the fuel pressure in the pressure control chamber 53 is further increased so that the fuel pressure in the pressure control chamber 53 becomes equal to the fuel pressure in the flow-in passage 52. Since the biasing force applied to the floating plate 70, which is caused by the pressure difference of the fuel pressure in the upper side space 53*c* and the lower side space 53*d*, disappears, the biasing force of the spring 55 is alone applied to the floating plate 70. The floating plate 70 is thereby moved upwardly to the first valve body 46, so that the inner and the outer press-contacting portions 72 and 74 are brought into contact with the pressure control surface 53*b*, at a timing t8 as shown in (d) of FIG. 6. An actual time for the valve portion 50 from its opening point (t2) to the closing point (t7) is around 3.0 msec.

Now, a further operation of the fuel injection device, in which the pressure control valve 80 is closed before the nozzle needle 60 reaches its maximum stoke (that is, its uppermost position), will be explained.

When the pressure control valve 80 is closed, the flow-out of the fuel is terminated and thereby the fuel pressure in the flow-out recessed portion 74*a* around the flow-out port 54*b* will be restored to its initial pressure, as a result that the fuel flows into the flow-out recessed portion 74*a* through the communication hole 71. The floating plate 70 is then pushed down in the direction to the valve portion 50 by the high pressure fuel in the flow-in recessed portion 72*a* from the flow-in ports 52*b*. The pressure control chamber 53 is brought into the communication with the flow-in passage 52.

When the high pressure fuel flows into the pressure control chamber 53, the fuel pressure therein will be restored to the initial pressure so that the nozzle needle 60 is moved downwardly in the direction to the valve portion 50. The nozzle needle 60 is moved down at the high speed and the seat portion 65 is seated on the valve seat portion 45 to close the valve portion 50. As already explained above, after the valve portion 50 is closed, the floating plate 70 is pushed up in the direction to the first valve body 46 by the spring force of the spring 55. Namely, the inner and the outer press-contacting portions 72 and 74 are brought into contact with the pressure control surface 53*b*.

Now, effects of the above explained first embodiment will be explained. According to the first embodiment, each of the areas of the flow-in recessed portions 72*a* and 74*a* is larger than the respective passage areas of the flow-in ports 52*b* and the flow-out port 54*b*. The outer and inner press-contacting portions 74 and 72 surrounding the flow-in and the flow-out recessed portions 72*a* and 74*a* are so configured as to be in contact with the pressure control surface 53*b*. Therefore, contacting areas between the press-contacting surface 73 and the pressure control surface 53*b* can be made smaller. Then, press-contacting force generated at the contacting areas between the outer and the inner press-contacting portions 74 and 72 and the pressure control surface 53*b* can be increased. Accordingly, it is possible to prevent leakage of the fuel from the flow-in ports 52*b* into the pressure control chamber 53 or from the flow-in ports 52 to the flow-out port 54*b* through any gap between the pressure control surface 53*b* and the press-contacting surface 73 of the floating plate 70, when the flow-out port 54*b* is communicated to the fuel return line 14*f* by the pressure control valve 80. Namely, the communication between the flow-in ports 52*b* and the pressure control chamber 53 as well as the communication between the flow-in ports 52*b* and the flow-out port 54*b* is surely blocked off.

As above, since the fuel flow from the flow-in ports 52*b* into the pressure control chamber 53 is surely blocked off, the fuel pressure in the pressure control chamber 53 is rapidly increased immediately after the flow-out passage 54 is communicated to the fuel return line 141. The nozzle needle 60 is thereby moved up toward the pressure control chamber 53 at the high speed, the seat portion 65 is lifted up from the valve seat portion 45, and the valve portion 50 is rapidly opened. Accordingly, it is possible to provide the fuel injection device 100, in which the response of the valve portion 50 to the driving current can be improved.

In addition, according to the first embodiment, the flow-in ports 52*b* and the flow-out port 54*b* are formed on the same side of the floating plate 70. As a result, a larger press-contacting force can be generated at the contacting areas between the outer and the inner press-contacting portions 74 and 72 and the pressure control surface 53*b*. Furthermore, since the outer and the inner press-contacting portions 74 and 72 are formed in the circular shape, a sufficient length necessary for the sealing can be obtained.

In addition, the floating plate 70 is biased in the axial direction to the first valve body 46, and the flow-in and the flow-out recessed portions 72*a* and 74*a* which are symmetric with respect to the center of the floating plate 70 are formed on the upper end surface thereof. The outer and the inner press-contacting portions 74 and 72 as well as the contacting surface areas between the press-contacting surface 73 and the pressure control surface 53*b* are likewise symmetric with respect to the center of the floating plate 70. As a result, the outer and the inner press-contacting portions 74 and 72 are equally pressed against the pressure control surface 53*b*. The pressing force for a unit contacting surface area at any portion is equal to that of the any other portions. The sealing performance between the outer and inner press-contacting portions 74 and 72 and the pressure control surface is improved.

In addition, according to the first embodiment, multiple flow-in ports 52*b* are formed at the pressure control surface 53*b*, the sum of the passage areas for the flow-in ports 52*b* can be increased. The flow-in space 83 can be surely filled with the fuel from the flow-in ports 52*b*. As a result, the movement of the floating plate 70 in the downward direction away from the pressure control surface 53*b* is surely carried out. A time delay for bringing the pressure control chamber 53 into communication with the flow-in ports 52*b* can be made smaller.

In addition, the multiple flow-in ports 52*b* are arranged at equal distances in the circumferential direction around the flow-out port 54*b*. The fuel pressure of the fuel flowing from the flow-in ports 52*b* to the pressure control chamber 53 is equally applied and distributed to the press-contacting surface 73 of the floating plate 70 in the circumferential direction. As a result, an inclination of the press-contacting surface 73 of the floating plate 70 with respect to the pressure control surface 53*b* can be suppressed, so that the floating plate 70 can be smoothly moved away from the pressure control surface 53*b*. In other words, speed of the smooth movement of the floating plate 70 can be increased.

It is desirable for the fuel to easily flow from the upper side space 53*c* to the lower side space 53*d* of the floating plate 70 so that the fuel pressure in the pressure control chamber 53 is smoothly increased as a whole. According to the first embodiment, the flow-in ports 52*b* are formed at such portions closer to the outer periphery of the pressure control surface 53*b* and opposed to the flow-in recessed portion 72*a* (which is formed at an outer peripheral portion of the floating plate 70). The fuel from the flow-in ports 52*b* may not stay in the space between the pressure control surface 53*b* and the press-contacting surface 73, but easily flow from the upper side space 53*c* to the lower side space 53*d* through the communication passages 77*a* formed at the side wall of the floating plate 70, as shown in FIG. 5B.

According to the fuel injection device 100 of the above structure, the floating plate 70 can be moved at high speed in order to smoothly increase the fuel pressure in the pressure control chamber 53 as a whole, after the communication between the flow-out port 54*b* and the fuel return line 14*f* is blocked off. The response of the valve portion 50 to the control signal can be surely increased.

In addition, according to the first embodiment, the inner press-contacting portion 72 of the floating plate 70 is pressed against the portion of the pressure control surface 53*b* surrounding the flow-out port 54*b*, to thereby surely decrease the fuel pressure around the flow-out port 54*b*. Furthermore, the fuel may flow out into the flow-out passage 54 from the pressure control chamber 53 through the communication hole 71 formed in the floating plate 70. It is, therefore, possible for the floating plate 70 to optimize the pressure decrease in the pressure control chamber 53. The floating plate 70 is strongly biased in the direction toward the flow-in passage 52 by the decreased pressure around the flow-out port 54*b*. And when the flow-out port 54*b* is in communication with the fuel return line 14*f*, the floating plate 70 is moved in the direction away from the pressure control surface 53*b*, so that the fuel pressure in the pressure control chamber 53 will be increased again due to the high pressure fuel flowing into the pressure control chamber from the flow-in ports 52*b*. When the pressure decrease of the fuel in the pressure control chamber 53 is adjusted by the communication hole 71, it becomes possible to rapidly move the nozzle needle 60 in the direction to the valve portion 50 so as to close the valve portion, immediately after the flow-out passage 54 is closed. It is, therefore, possible to provide the fuel injection device 100 which has a quick response to the driving current.

In addition, since the communication hole 71 is formed in the floating plate 70 for communicating the pressure control chamber 53 (the lower side space 53*d*) to the flow-out port 54*b*, the floating plate 70 receives a pressure from the fuel flowing through the communication hole 71, when the press-contacting surface 73 of the floating plate 70 is pressed against the pressure control surface 53*b*. The communication hole 71 is formed at the center of the disc shaped floating plate 70 in the radial direction and extends in the axial direction thereof. The pressure applied to the floating plate 70 by the fuel flowing through the communication hole 71 is equally distributed to the press-contacting surface 73, so that the floating plate 70 is equally pressed against the pressure control surface 53*b* in the circumferential direction of the floating plate 70. As a result, the flow-in ports 52*b* as well as the flow-out port 54*b* are surely closed by the floating plate 70.

Flow amount of the fuel flowing through the communication hole 71 is decided by the passage area of the restricted portion 71*c*. Therefore, the flow amount can be freely adjusted by changing in advance the passage area of the restricted portion 7*c*. Speed of the fuel pressure decrease in the pressure control chamber 53, which takes place (between the timings t3 and t4 of FIG. 6) after the press-contacting surface 73 is pressed against the pressure control surface 53*b*, depends on the passage area of the restricted portion 71*c*. Accordingly, the movement (the moving speed) of the nozzle needle 60, which opens and closes the valve portion 50 depending on the fuel pressure in the pressure control chamber 53, can be optimized.

Generally, viscosity of the fuel becomes higher as the temperature becomes lower, and it becomes harder for the fuel to flow through a smaller passage. Therefore, the flow amount of the fuel flowing through the small passage depends more largely on the temperature of the fuel, as the passage area becomes smaller. According to the first embodiment, the recessed portion 71*b* having a larger opening area is formed on the lower side surface of the floating plate 70, so that variation of the fuel amount flowing through the communication hole 71 and depending on the fuel temperature can be suppressed. It is possible to suppress variation of the speed of the fuel pressure decrease in the pressure control chamber 53, even in the case that the fuel temperature is changed. As a result, it is possible for the fuel injection device 100 to realize higher accuracy for the fuel injection without being influenced by the temperature change.

The fuel flowing through the communication hole 71 applies the pressure to the floating plate 70, so that the floating plate 70 may be bent upwardly. According to the first embodiment, the restricted portion 71*c* is formed in the communication hole 71 at a portion closer to the press-contacting surface 73 to keep a high rigidity. A possible deformation of the floating plate 70 is thus suppressed.

As already explained above, the recessed portion 71*b* is formed on the lower side surface of the floating plate 70 in order to suppress the variation of the flow amount depending on the fuel temperature. Since the recessed portion 71*b* is formed on the lower side surface, a decrease of the rigidity of the floating plate 70 against the pressure for bending the floating plate 70 upwardly may be suppressed. As a result, it is possible not only to suppress the variation of the flow amount depending on the fuel temperature but also to decrease the deformation of the floating plate 70. Even though the communication hole 71 is formed in the center of the floating plate 70, the inner and outer pres-contacting portions 72 and 74 can be surely brought into contact with the pressure control surface 53*b* along their circular shapes. The flow-in ports 52*b* can be surely blocked off by the floating plate 70 from the pressure control chamber 53 and from the flow-out port 54*b*.

As explained above, it is desirable for the fuel to easily flow from the upper side space 53*c* to the lower side space 53*d* of the floating plate 70 so that the fuel pressure in the pressure control chamber 53 is smoothly increased as a whole. However, if a gap between the side wall portion 76 and the inner peripheral wall 57 of the cylinder 56 was made larger in order to realize a smooth fuel flow from the upper side space 53*c* to the lower side space 53*d*, it might cause another problem in which the floating plate 70 may be displaced in the radial direction (that is, the direction along the pressure control surface 53*b*), or in which the floating plate 70 may be inclined with respect to the axial direction thereof.

According to the first embodiment, the communication passages 77*a* are formed by the passage wall portions 77 (which are formed at the outer side wall 75 of the floating plate 70) and the inner peripheral wall 57 of the cylinder 56, so that the fuel may smoothly and surely flow from the upper side space 53*c* to the lower side space 53*d*. Accordingly, it is possible to realize a sufficient amount of the fuel flow in the communication passages 77*a*, even though the gap between the side wall portion 76 and the inner peripheral wall 57 of the cylinder 56 was made smaller. As a result of the above structure, a time delay from the timing at which the fuel pressure in the upper side space 53*c* is increased as a result of the communication between the flow-in ports 52*b* and the pressure control chamber 53 to the timing at which the fuel pressure in the lower side space 53*d* is increased can be made shorter.

In addition, since the gap between the side wall portion 76 and the inner peripheral wall 57 of the cylinder 56 is made smaller, it is possible to avoid the above explained problems, in which the floating plate 70 may be displaced in the radial direction or in which the floating plate 70 may be inclined with respect to the axial direction thereof. Accordingly, the floating plate 70 can be surely moved upwardly or downwardly, to thereby communicate the flow-in ports 52*b* to the pressure control chamber 53 or to block off the communication between the flow-in ports 52*b* and the pressure control chamber 53 (including the communication between the flow-in ports 52*b* and the flow-out port 54*b*).

In addition, according to the first embodiment, the communication passages 77*a* are formed at the outer side wall 75 and the flow-in ports 52*b* are formed at such portions of the pressure control surface 53*b* closer to the outer periphery of the floating plate 70. As a result of the synergy effect of the above structures, the fuel flows more smoothly into the lower side space 53*d*. As shown in FIG. 5B, the fuel flows from the flow-in ports 52*b* into the upper side space 53*c*, and the fuel further flows from the upper side space 53*c* into the lower side space 53*d* along the outer side wall 75 and through the communication passages 77*a* and the communication space 78. Since the passage area of the communication passages 77*a* and the communication space 78 is made larger than the passage area of the flow-in ports 52*b*, the fuel can easily flow from the upper side space 53*c* to the lower side space 53*d*. In addition, since the multiple communication passages 77*a* are formed in the floating plate 70, the fuel flows from the upper side space 53*c* into multiple portions of the lower side space 53*d*. In addition, since the passage wall portion 77 is formed by the flat wall surface along the axial direction (the reciprocating direction), the communication passage 77*a* extends in the axial direction. It is, therefore, possible to reduce the resistance for the fuel flow from the upper side space 53*c* to the lower side space 53*d*. As above, the fuel surely flows from the upper side space 53*c* to the lower side space 53*d* through the communication passage 77*a* and the communication space 78.

When the communication between the flow-out port 54*b* and the fuel return line 14*f* is blocked off (at the timing t6 of FIG. 6), the fuel pressure of the pressure control chamber 53 (including the upper and lower side spaces 53*c* and 53*d*) is rapidly increased, so that the nozzle needle 60 is moved down at the high speed to close the valve portion 50 and thereby terminate the fuel injection from the injection ports 44.

The longitudinal cross sectional shape of the outer side wall 75 of the floating plate 70 has the curved side wall projecting in the radial outward direction of the floating plate 70. Therefore, even in the case that the floating plate 70 is inclined with respect to the cylinder 56, the curved side wall 75 is not caught by the inner peripheral wall 57 of the pressure control chamber 53. The floating plate 70 can be stably maintained in its normal position, so that the movement thereof can be surely done to thereby surely block off the communication between the flow-in ports 52*b* and the pressure control chamber 53.

Furthermore, according to the first embodiment, the floating plate 70 is biased by the spring 55 in the upward direction, so that the inner and outer press-contacting portions 72 and 74 are brought into contact with the pressure control surface 53*b*. With such floating plate 70 biased by the spring 55, it is possible to quickly block off the communication between the flow-in ports 52*b* and the pressure control chamber 53 without a substantial displacement (movement) of the floating plate 70, immediately when the flow-out port 54*b* is communicated with the fuel return line 14*f* by the pressure control valve 80. Accordingly, it is possible to shorten the time period from the timing at which the pressure control valve 80 is opened (at the timing t1) to the timing at which the fuel pressure in the pressure control chamber 53 starts to decrease (at the timing t2). This would lead to the effect that the response of the valve portion 50 with respect to the control signal is improved.

Furthermore, according to the first embodiment, the flow-in recessed portion 72*a* as well as the flow-out recessed portion 74*a* is formed on the same press-contacting surface 73. Even when the floating plate 70 having the press-contacting surface 73 is displaced with respect to the pressure control surface 53*b*, the relative positions of the flow-in recessed portion 72*a* the flow-out recessed portion 74*a* are not changed. The contacting areas between the press-contacting surface 73 and the pressure control surface 53*b* are not changed, even when the relative position of the floating plate 70 to the pressure control surface 53*b* is changed. Therefore, it is possible to surely block off the communication between the flow-in ports 52*b* and the flow-out port 54*b*, irrespectively of the relative position of the floating plate 70 to the pressure control surface 53*b*.

Second Embodiment

A second embodiment of the present invention will be explained with reference to FIGS. 7 to 10, wherein a fuel injection device 200 is a modification of the fuel injection device 100 of the first embodiment. Hereinafter, a valve body 246, a cylinder 256, and a floating plate 270 of the second embodiment will be explained. An element corresponding to the spring 55 of the first embodiment is eliminated in the second embodiment.

Figure 7:
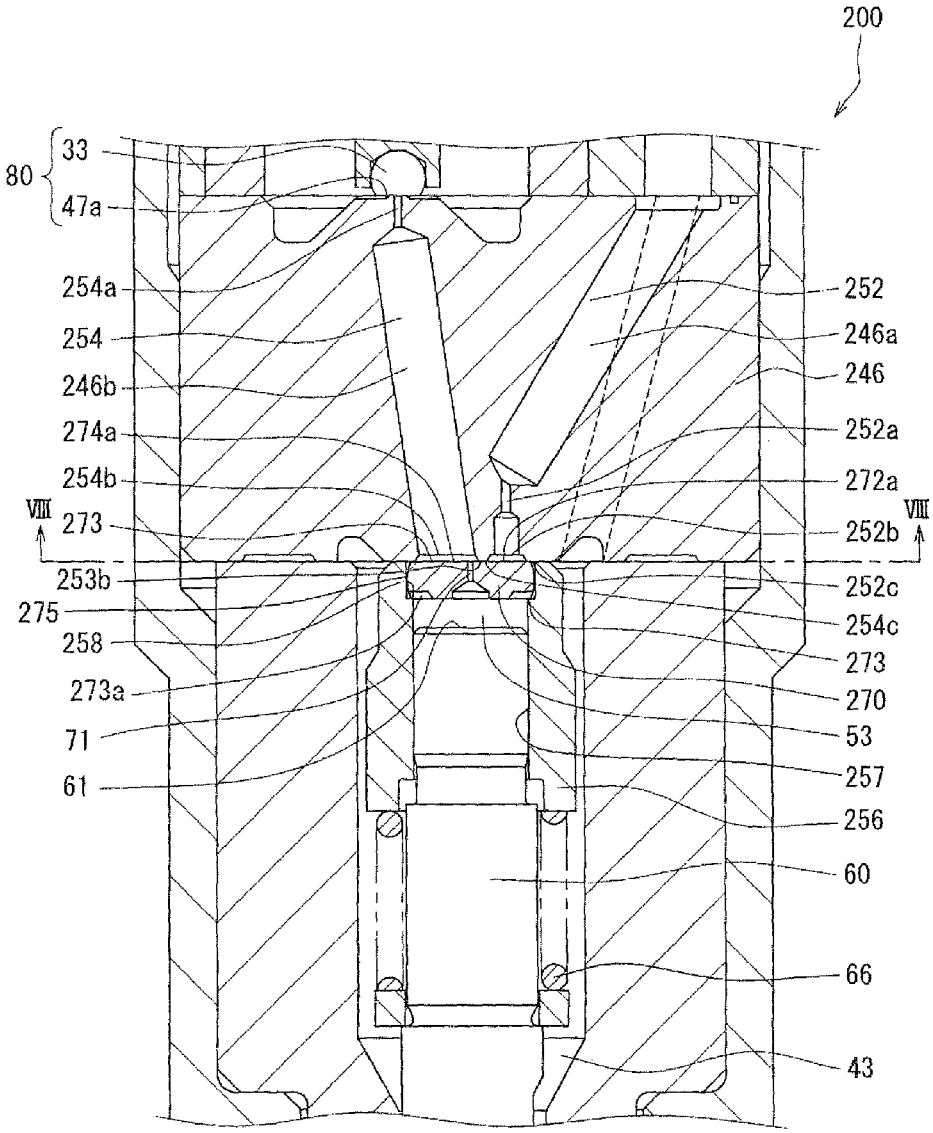
FIG. 7 is an enlarged cross sectional view showing a characterizing portion of a fuel injection device according to a second embodiment of the present invention.
Figure 8:
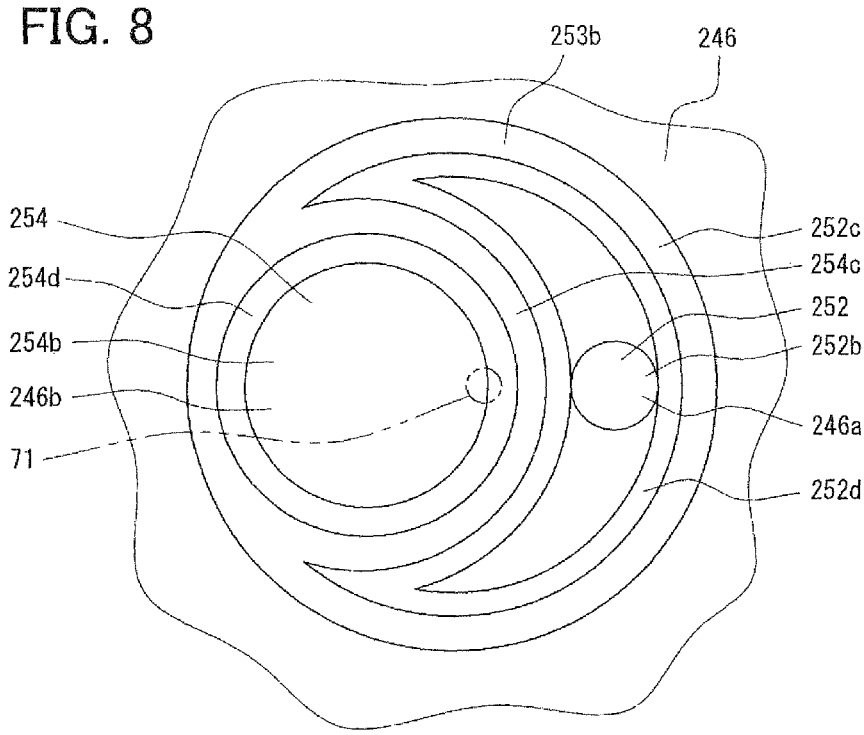
FIG. 8 is a cross sectional view taken along a line VIII-VIII in FIG. 7 showing a pressure control surface of a valve body.
Figure 9:
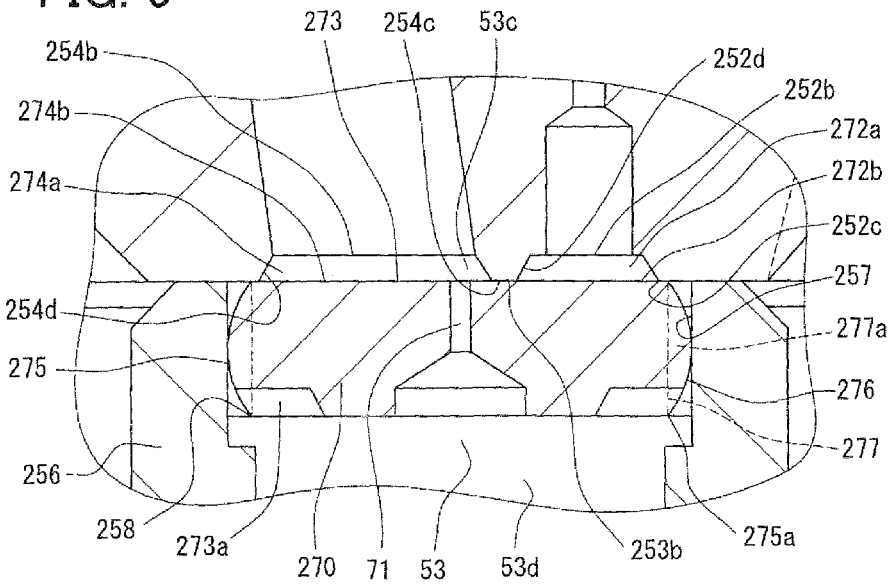
FIG. 9 is a further enlarged cross sectional view showing the characterizing portion of the fuel injection device of the second embodiment.

As shown in FIGS. 7 to 9, the valve body 246 corresponds to the first and second valve bodies 46 and 47 of the first embodiment. Longitudinal through-holes 246*a* and 246*b* extending in a longitudinal direction of the valve body 246 are formed in the valve body 246 as a part of a flow-in passage 252 and a part of a flow-out passage 254, respectively. Each of the longitudinal through-holes 246*a* and 246*b* is inclined to the axial direction of the valve body 246. The longitudinal through-hole 246*b* (the part of the flow-out passage 254) is opened at a pressure control surface 253*b* (of a circular shape) as a flow-out port 254*b*, which is offset from a center of the pressure control surface 253*b*. A restricted portion 254*a* is formed in the longitudinal through-hole 246*b*. The longitudinal through-hole 246*a* (the part of the flow-in passage 252) is opened at the pressure control surface 253*b* as a flow-in port 252*b*, which is offset from the center of the pressure control surface 253*b* on an opposite side of the flow-out 254*b*. A restricted portion 252*a* is formed in the longitudinal through-hole 246*a*.

A flow-out recessed portion 274*a* and a flow-in recessed portion 272*a* are formed at the pressure control surface 253*b* (of the circular shape) of the valve body 246. The flow-out recessed portion 274*a* is formed by depressing a part of the pressure control surface 253*b* in an upward direction away from a press-contacting surface 273 of the floating plate 270, so that a circular wall 254*d* surrounding the flow-out port 254*b* is formed (also referred to as a flow-out-port surrounding portion). The circular wall 254*d* is offset from a center of the pressure control surface 253*b*. The flow-out port 254*b* is opened at a center of an area surrounded by the circular wall 254*d*. The flow-in recessed portion 272*a* is likewise formed by depressing a part of the pressure control surface 253*b* in the upward direction away from the press-contacting surface 273 of the floating plate 270, so that a lunate recess is formed. A lunate wall 252*d* surrounds the flow-in port 252*b*, which is opened at the lunate recess (the flow-in recessed portion 272*a*).

As a result of forming the flow-out recessed portion 274*a* and the flow-in recessed portion 272*a* at the pressure control surface 253*b* of the valve body 246, a flow-out-side contacting portion 254*c* and a flow-in-side contacting portion 252*c* are formed on the remaining portions of the pressure control surface 253*b*. Those contacting portions 254*c* and 252*c* are projections projecting toward the floating plate 270 and opposed to the press-contacting surface 273 of the floating plate 270, so that the contacting portions 254*c* and 252*c* are operatively brought into contact with the floating plate 270 (the press-contacting surface 273). The contacting portion 254*c* has a circular surface surrounding the flow-out recessed portion 274*a* and being in contact with the press-contacting surface 273. The contacting portion 252*c* likewise has a circular surface surrounding the flow-in recessed portion 272*a* and being in contact with the press-contacting surface 273 (the outer periphery of the floating plate 270). A part of the contacting portion 254*c* and a part of the contacting portion 252*c* are overlapped with each other at a left-hand side in FIG. 8.

A stepped portion 258 is formed at the inner peripheral wall 257 of the cylinder 256, which defines the pressure control chamber 53, as a stopper for limiting a downward movement of the floating plate 270 (in a direction that the press-contacting surface 273 is moved away from the pressure control surface 253*b*).

The floating plate 270 has the press-contacting surface 273, a contacting portion 275*a* and multiple flow limiting grooves 273*a*. The press-contacting surface 273 is a flat surface, which is opposed to the pressure control surface 253*b*. The press-contacting surface 273 has a flow-out-side surface portion 274*b* opposing to the flow-out recessed portion 274*a* and a flow-in-side surface portion 272*b* opposing to the flow-in recessed portion 272*a*. Each of the surface portions 274*b* and 272*b* is brought into contact with and pressed against the respective circular surfaces of the contacting portions 252*c* and 254*c*.

The contacting portion 275*a* is an outer peripheral portion of a lower side surface, which is opposite to the press-contacting surface 273 of the floating plate 270 and opposed to the stepped portions 258 of the cylinder 256. The contacting portions 275*a* are brought into contact with the stepped portion 258, when the floating plate 270 is moved downwardly. The flow limiting grooves 273*a* are formed at the lower side surface of the floating plate 270, wherein each of the grooves 273*a* extends in a radial direction to the contacting portion 275*a*. According to the above structure, the fuel may flow from the upper side space 53*c* to the lower side space 53*d*, even when the contacting portions 275*a* are in contact with the stepped portion 258. When the pressure control valve 80 is closed, the floating plate 270 is downwardly moved away from the valve body 246 so that the contacting portions 275*a* are brought into contact with the stepped portion 258.

A side wall portion 276 and multiple passage wall portions 277 are formed at an outer side wall 275 of the floating plate 270. The side wall portion 276 having a curved cross section is in a sliding contact with the inner peripheral wall 257 of the cylinder 256, so that the floating plate 270 is movably accommodated in the cylinder 256.

The passage wall portions 277 are formed by cutting away portions of the outer side wall 275, so that multiple communication passages 277*a* are formed to communicate the upper side space 53*c* and the lower side space 53*d* with each other. Each of the passage wall portions 277 is formed in a flat wall extending in a direction parallel to the longitudinal axis of the floating plate 270. A pair of passage wall portions 277 is formed at opposite positions in the radial direction.

According to the second embodiment, the fuel flow from the upper side space 53*c* to the lower side space 53 is mainly carried out by the fuel flow through the communication passages 277*a*. Namely, the fuel flow through a gap between the side wall portion 276 and the inner peripheral wall 257 is negligible. A sum of the passage areas for the communication passages 277*a* is made larger than the passage area of the flow-in port 252*b* (more exactly, the passage area of the restricted portion 252*a* of the flow-in passage 252).

An operation of the above explained fuel injection device 200, in which the valve portion 50 is opened and closed depending on the driving current from the engine control unit 17 (FIG. 1) to thereby inject the fuel, will be explained with reference to FIG. 10 in addition to FIGS. 7 to 9.

Figure 10:
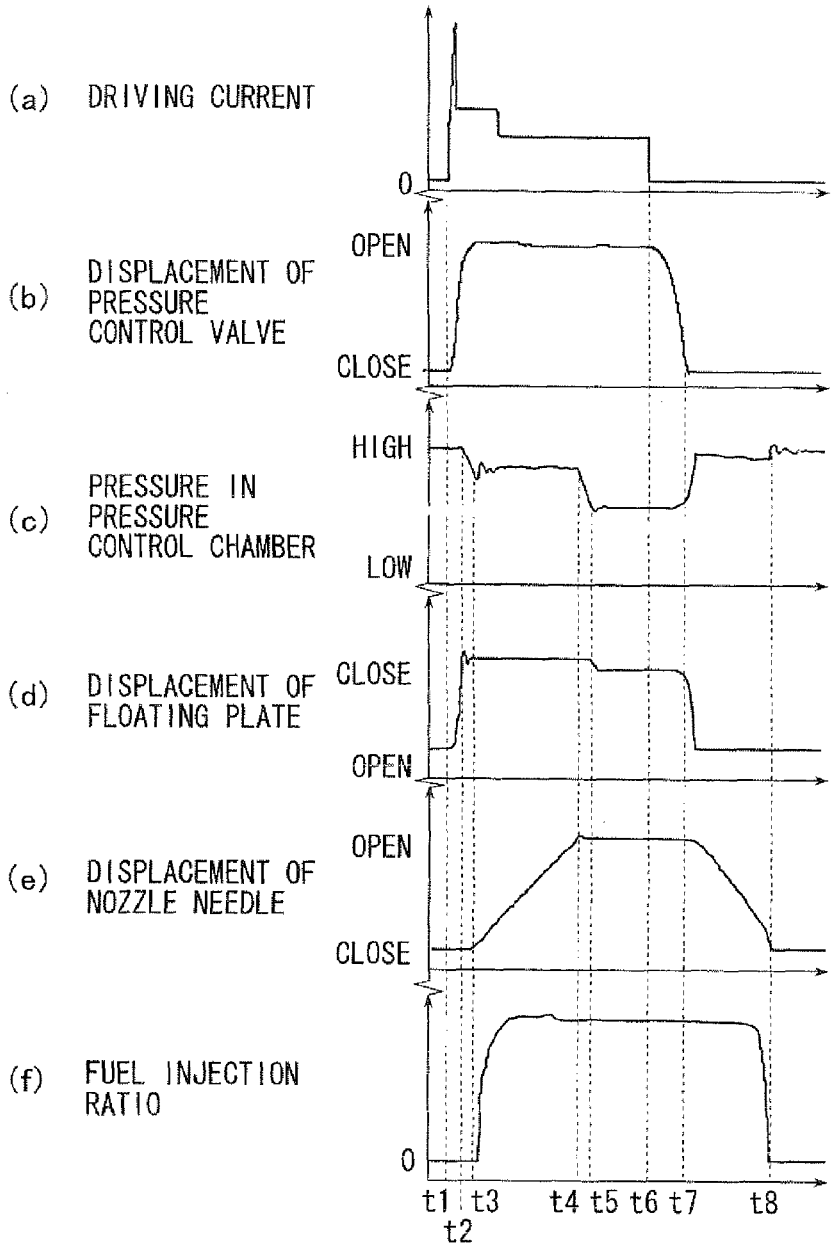
FIG. 10 is a chart showing operation of the fuel injection device of the second embodiment.

When the driving current of the pulse shape is supplied from the engine control unit 17 to the solenoid 31 (FIG. 2) at a timing t1 (as shown in (a) of FIG. 10), the magnetic field is generated to operate the pressure control valve 80 so as to open the valve. When the pressure control valve 80 starts to open (as shown in (b) of FIG. 10), the fuel starts to flow out from the flow-out port 254*b* which is brought into the communication with the fuel return line 14*f* (FIG. 1). The fuel pressure in the pressure control chamber 53 is decreased at first in an area neighboring to the flow-out port 254*b*. The pressure applied to the flow-out-side surface portion 274*b* of the floating plate 270 is decreased due to the pressure decrease around the flow-out port 254*b*. Then, the floating plate 270 starts to move upwardly and the press-contacting surface 273 is brought into contact with and pressed against the respective circular surfaces of the contacting portions 252*c* and 254*c* of the valve body 246, at a timing t2 (as shown in (d) of FIG. 10). The floating plate 270 blocks off the communication between the flow-in port 252*b* and the pressure control chamber 53.

The fuel flows from the lower side space 53*d* of the pressure control chamber 53 into the upper side space 53*c* through the communication hole 71 of the floating plate 270, and is discharged from the flow-out port 254*b*. Since the flow-in port 252*b* is closed, the fuel pressure in the pressure control chamber 53 is rapidly decreased, at a timing t3 (as shown in (c) of FIG. 10). Then, a sum of the fuel pressure applied to the pressure receiving surface 61 of the nozzle needle 60 and the biasing force of the spring 66 immediately becomes smaller than a needle lifting force applied to the seat portion 65 of the nozzle needle 60 by the fuel pressure in the nozzle-needle accommodating portion 43. The nozzle needle 60 starts to move upwardly at a high speed in the direction to the pressure control chamber 53, at the timing t3 as shown in (e) of FIG. 10. During the upward movement of the nozzle needle 60, the fuel pressure in the pressure control chamber 53 is maintained at a constant value.

When the upward movement of the nozzle needle 60 in the direction to the pressure control chamber 53 is terminated, the fuel pressure in the pressure control chamber 53 is further decreased, at a timing t4 (as shown in (c) of FIG. 10). Then, the fuel pressure in the pressure control chamber 53 comes down closer to the fuel pressure in the area neighboring to the flow-out port 254*b*, at a timing t5 (as shown in (c) of FIG. 10). The fuel pressure in the flow-out recessed portion 274*a* is applied to the flow-out-side surface portion 274*b* of the floating plate 270. As a result, the biasing force applied to the floating plate 270 by the fuel pressure in the upward direction becomes smaller. Contrary to that, a difference of the fuel pressure between the fuel pressure in the area neighboring to the flow-in port 252*b* applied to the flow-in-side surface portion 272*b* and the fuel pressure in the pressure control chamber 53 is increased. The floating plate 270 is thereby pushed down in the direction to the pressure receiving surface 61, at the timing t5 (as shown in (d) of FIG. 10).

When the floating plate 270 is moved downwardly, the flow-in passage 252 is brought into communication again with the pressure control chamber 53, so that the high pressure flows again into the pressure control chamber 53. Therefore, the fuel pressure decrease in the pressure control chamber 53 is stopped, as shown in (c) of FIG. 10. The lunate flow-in recessed portion 272*a* is surrounded by the contacting portions 252*c* and 254*c*. An integrated value, which is calculated by multiplying a length of the contacting portions 252*c* and 254*c* surrounding the lunate flow-in recessed portion 272*a* by a displaced amount of the floating plate 270, corresponds to a passage area for the fuel flow between the floating plate 270 and the valve body 246. It is, therefore, desirable that the floating plate 270 is moved to such a position, at which the passage area for the fluid flow between the floating plate 270 and the valve body 246 becomes larger than the passage area of the restricted portion 252*a* of the flow-in passage 252.

When the supply of the driving current from the engine control unit 17 to the solenoid 31 is terminated, the pressure control valve 80 starts to close, at a timing t6 as shown in (b) of FIG. 10. When the pressure control valve 80 is closed at a timing t7 (as shown in (b) of FIG. 10), the flow-out of the fuel through the flow-out passage 254 is stopped and thereby the fuel pressure in the pressure control chamber 53 is immediately increased, as shown in (c) of FIG. 10. The floating plate 270 is then further pushed down by the pressure applied to the flow-in-side surface portion 272*b* and moved to a position, at which the contacting portions 275*a* are brought into contact with the stopper 258, as shown in (d) of FIG. 10. The sum of the fuel pressure applied to the pressure receiving surface 61 of the nozzle needle 60 and the biasing force of the spring 66 immediately becomes larger than the needle lifting force applied to the seat portion 65 of the nozzle needle 60 by the fuel pressure in the nozzle-needle accommodating portion 43. The nozzle needle 60 starts to move downwardly at a high speed in the valve portion 50, which is finally closed at a timing t8 as shown in (e) of FIG. 10.

Effects of the Second Embodiment

According to the above explained second embodiment, the floating plate 270 has a function of fluid sealing between the press-contacting surface 273 and the flow-in-side and flow-out-side contacting portions 252*c* and 254*c*, so that the communication between the flow-in port 252*b* and the pressure control chamber 53 can be surely blocked off. As a result, it is possible to rapidly decrease the fuel pressure in the pressure control chamber 53 when the pressure control valve 80 is opened, to thereby realize the high speed movement of the nozzle needle 60. As above, the response of the valve portion 50 to the driving current can be improved.

Furthermore, according to the second embodiment, the circular wall 254*d* of the flow-out recessed portion 274*a* is offset from the center of the pressure control surface 253*b*, so that the flow-out-side and the flow-in-side contacting portions 252*c* and 254*c* are arranged to be neighboring to each other. The contacting areas between the pressure control surface 253*b* and the press-contacting surface 273 can be reduced by arranging the flow-out-side and the flow-in-side contacting portions 252*c* and 254*c* neighboring to each other. The pressing force of the press-contacting surface 273 to the pressure control surface 253*b* can be thereby increased, so that the floating plate 270 can surely block off the communication between the flow-in port 252*b* and the pressure control chamber 53 and the communication between the flow-in port 252*b* and the flow-out port 254*b*.

Furthermore, according to the second embodiment, the downward movement of the floating plate 270 is limited by the stepped portion 258, with which the contacting portions 275*a* of the floating plate 270 are brought into contact. Namely, it is possible to constantly place the floating plate 270 at a predetermined position, which is separated from the pressure control surface 253*b* by a predetermined distance. As a result, it is possible to maintain a time period, which is a period from the timing at which the flow-out port 254*b* is brought into communication with the fuel return line 14*f* (namely, when the pressure control valve 80 is opened) to the timing at which the floating plate 270 blocks off the communication between the flow-in port 252*b* and the pressure control chamber 53, within a predetermined time. Accordingly, the fuel pressure in the pressure control chamber 53 can be rapidly decreased.

In addition, according to the second embodiment, since the flow limiting grooves 273*a* are formed at the contacting portions 275*a* of the floating plate 270, the fuel may flow from the upper side space 53*c* to the lower side space 53*d* even when the contacting portions 275*a* are in contact with the stepped portion 258.

In addition, according to the second embodiment, the flow-out and flow-in recessed portions 274*a* and 272*a* are formed at the pressure control surface 253*b*, and the press-contacting surface 273 of the floating plate 270 is formed in the flat surface. As a result, even when the floating plate 270 is rotated around the axis thereof, the press-contacting surface 273 of the floating plate 270 can be surely brought in contact with the contacting portions 252*c* and 254*c*, to thereby surely block off the communication between the flow-in port 252*b* and the pressure control chamber 53 and the communication between the flow-in port 252*b* and the flow-out port 254*b*.

In addition, according to the second embodiment, the side wall portion 276 of the floating plate 270 is in a sliding contact with the inner peripheral wall 257 of the cylinder 256, so that the floating plate 270 is movable in the cylinder 256. A gap between the side wall portion 276 of the floating plate 270 and the inner peripheral wall 257 of the cylinder 256 is negligible. A movement of the floating plate 270 in the radial direction is restricted. A relative displacement of the press-contacting surface 273 of the floating plate 270 with respect to the pressure control surface 253*b* is thereby suppressed. If the floating plate 270 was displaced in the radial direction, the pressure applied to the floating plate 270 may be disbalanced and thereby local wear-out may occur. However, according to the second embodiment, the displacement of the floating plate 270 in the radial direction is suppressed to thereby prevent the local wear-out of the press-contacting surface 273 as well as the pressure control surface 253*b*. As a result, it is possible that the floating plate 270 demonstrates its sealing effect for a longer time period. Furthermore, a possible inclination of the floating plate 270 with respect the inner peripheral wall 257 may be suppressed.

Third Embodiment

A third embodiment of the present invention will be explained with reference to FIGS. 11 to 14, wherein a fuel injection device 300 is a further modification of the fuel injection device 100 of the first embodiment. Hereinafter, a valve body 346 and a floating plate 370 of the third embodiment will be explained.

Figure 11:
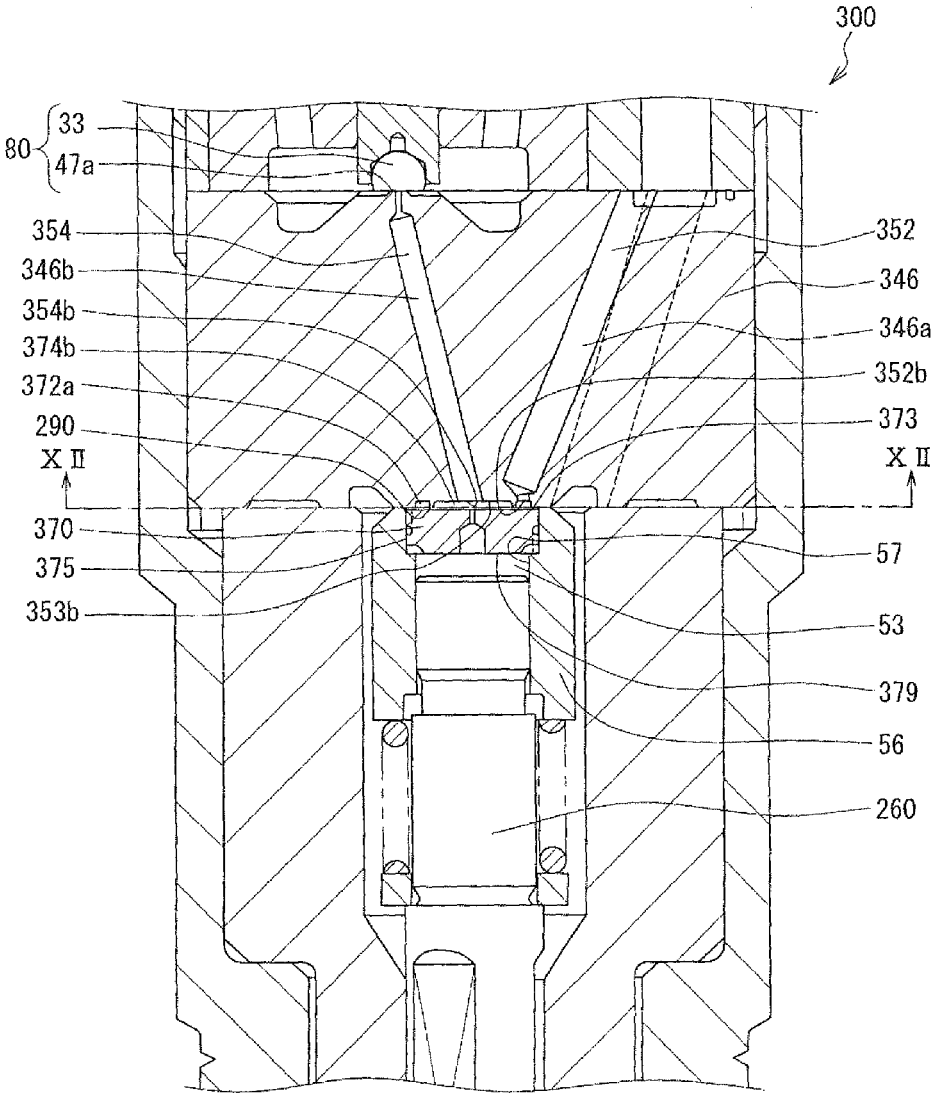
FIG. 11 is an enlarged cross sectional view showing a characterizing portion of a fuel injection device according to a third embodiment of the present invention.

The valve body 346 corresponds to the first and second valve bodies 46 and 47 of the first embodiment. As shown in FIG. 11 and in a similar manner to the second embodiment, longitudinal through-holes 346*a* and 346*b* extending in a longitudinal direction of the valve body 346 are formed in the valve body 346 as a part of a flow-in passage 352 and a part of a flow-out passage 354, respectively. Each of the longitudinal through-holes 346*a* and 346*b* is inclined to the axial direction of the valve body 346. The longitudinal through-hole 346*b* (the part of the flow-out passage 354) is opened at a pressure control surface 353*b* (of a circular shape) as a flow-out port 354*b*. And the longitudinal through-hole 346*a* (the part of the flow-in passage 352) is opened at the pressure control surface 353*b* as a flow-in port 352*b*, which is offset from a center of the pressure control surface 353*b*.

Figure 13:
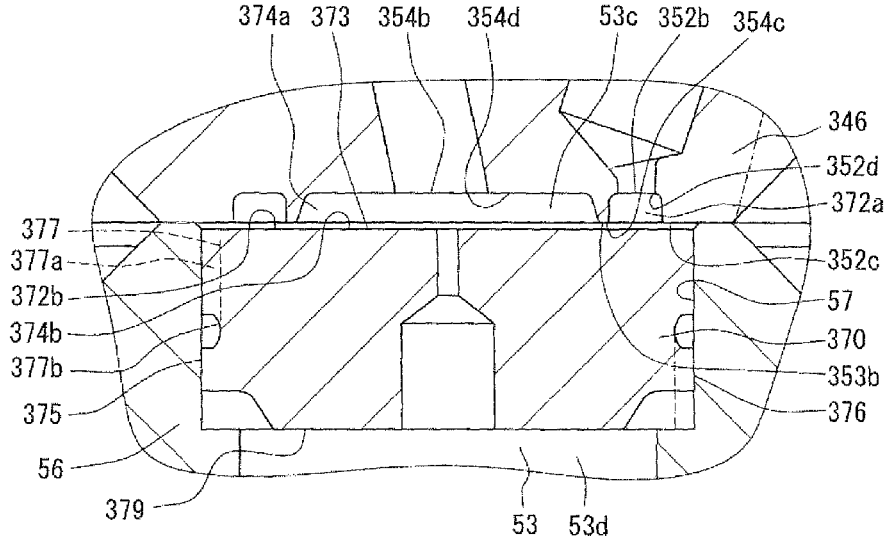
FIG. 13 is a further enlarged cross sectional view showing the characterizing portion of the fuel injection device of the third embodiment.

As shown in FIG. 13, a flow-out recessed portion 374*a* and a flow-in recessed portion 372*a* are formed at the pressure control surface 353*b* (of the circular shape) of the valve body 346. The flow-out recessed portion 374*a* is formed by depressing a part of the pressure control surface 353*b* in an upward direction away from a press-contacting surface 373 of the floating plate 370, so that a circular bottom surface 354*d* surrounding the flow-out port 354*b* is formed (also referred to as a flow-out-port surrounding portion). The flow-out port 354*b* of a round shape is opened at a center of an area (that is, the flow-out recessed portion 374*a*) surrounded by the circular bottom surface 354*d*. The flow-in recessed portion 372*a* is likewise formed by depressing a part of the pressure control surface 353*b* in the upward direction away from the press-contacting surface 373 of the floating plate 370, so that an annular recess is formed. An annular bottom surface 352*d* surrounds the flow-in port 352*b*, which is opened at the annular recess (that is, the flow-in recessed portion 372*a*).

Figure 12:
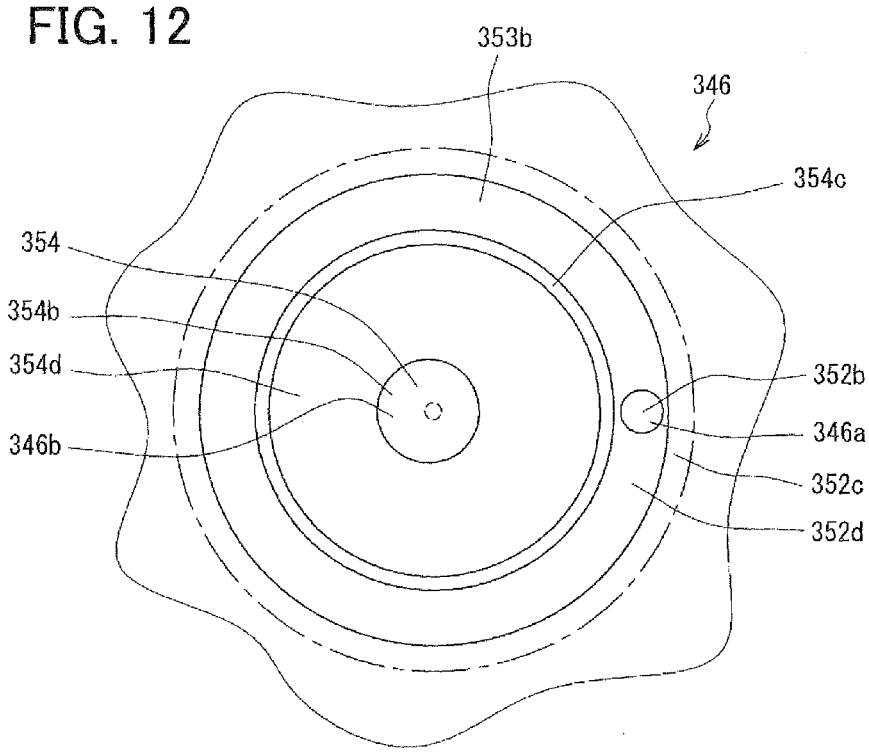
FIG. 12 is a cross sectional view taken along a line XII-XII in FIG. 11 showing a pressure control surface of a valve body.

As shown in FIGS. 12 and 13, as a result of forming the flow-out recessed portion 374*a* and the flow-in recessed portion 372*a* at the pressure control surface 353*b* of the valve body 346, a flow-out-side contacting portion 354*c* and a flow-in-side contacting portion 352*c* are formed on the remaining portions of the pressure control surface 353*b*. Those contacting portions 354*c* and 352*c* are projections projecting toward the floating plate 370 and opposed to the press-contacting surface 373 of the floating plate 370, so that the contacting portions 354*c* and 352*c* are operatively brought into contact with the floating plate 370 (the press-contacting surface 373). The contacting portion 354*c* has a circular surface surrounding the flow-out recessed portion 374*a* and being in contact with the press-contacting surface 373. The contacting portion 352*c* likewise has a circular surface surrounding the flow-in recessed portion 372*a* and being in contact with the press-contacting surface 373 (the outer periphery of the floating plate 370). The circular contacting portions 354*c* and 352*c* are coaxially arranged with the center of the pressure control surface 353*b*.

The press-contacting surface 373 of the floating plate 370 is a flat surface, which is opposed to the pressure control surface 353*b*. The press-contacting surface 373 has a flow-in-side surface portion 372*b* opposing to the flow-in recessed portion 372*a* and a flow-out-side surface portion 374*b* opposing to the flow-out recessed portion 374*a*. Each of the surface portions 372*b* and 374*b* is brought into contact with and pressed against the respective circular surfaces of the contacting portions 352*c* and 354*c*.

A side wall portion 376 and multiple passage wall portions 377 are formed at an outer side wall 375 of the floating plate 370. The side wall portion 376 is in a sliding contact with the inner peripheral wall 57 of the cylinder 56, so that the floating plate 370 is movably accommodated in the cylinder 56. A gap between the side wall portion 376 and the inner peripheral wall 57 is negligible and fuel may not flow through the gap.

Figure 14A:
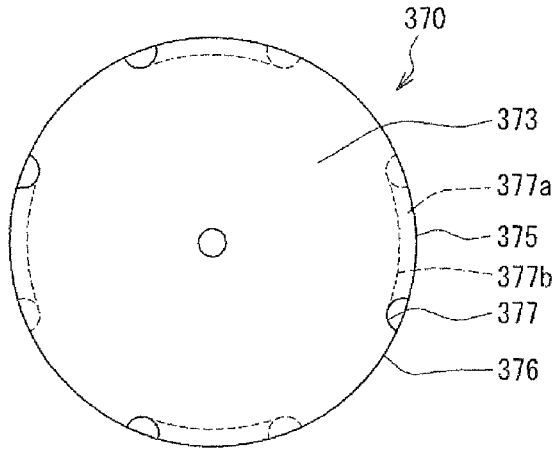
Figure 14B:
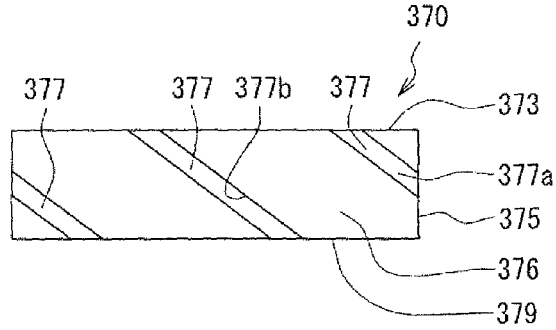

The passage wall portions 377 are formed at the outer peripheral surface of the side wall portion 376 by cutting away portions thereof. As shown in FIGS. 14A and 14B, according to the third embodiment, the passage wall portions 377 form multiple grooves 377*b* at the outer peripheral surface of the side wall portion 376, each of which is opened at one end to an upper side of the floating plate 370 (that is, the side of the press-contacting surface 373) and at its other end to a lower side 379 of the floating plate 370 (that is, the side to the lower side space 53*d*). Namely, the grooves 377*b* are communication passages 377*a*, which are formed by the passage wall portions 377 and the inner peripheral wall 57 and which communicate the upper side space 53*c* and the lower side space 53*d* of the pressure control chamber 53 with each other. The grooves 377*b* are spirally formed at the outer peripheral surface of the side wall portion 376. Therefore, when the floating plate 370 is projected in the axial direction thereof, as shown in FIG. 14A, an open end of the communication passage 377*a* on the upper side of the floating plate 370 is displaced in a circumferential direction from the other open end of the same communication passage 377*a* on the opposite (lower) side of the floating plate 370. Four communication passages 377*a* (that is, the grooves 377*b*) are formed at equal distances in the circumferential direction at the outer peripheral surface of the side wall portion 376.

According to the third embodiment, the fuel flow from the upper side space 53*c* to the lower side space 53*d* of the pressure control chamber 53 is mainly carried out by the fuel flow through the communication passages 377*a*. In other words, the fuel flow through the gap between the side wall portion 376 and the inner peripheral wall 57 is negligible. A sum of the passage areas for the communication passages 377*a* is made larger than the passage area of the flow-in port 352*b*.

According to the first embodiment, the passage wall portions are formed in the flat wall surfaces. However, as in the third embodiment, the communication passages may be formed by spiral grooves 377*b*. In addition, the projected areas of the communication passages 377*a*, which are formed when projecting the floating plate 370 in the axial direction, can be a part of the pressure receiving surface. Therefore, it is possible with the spiral grooves to suppress the decrease of the pressure receiving surface. The pressing force of the press-contacting surface 373 to the pressure control surface 353*b* can be maintained at a high value for the floating plate 370 having the passage wall portions 377.

In addition, according to the third embodiment, the flow-in port 352*b* is offset from the center of the pressure control surface 353*b*, and multiple grooves 377*b* are formed at equal distances in the circumferential direction at the outer periphery of the side wall portion 376. Accordingly, even when the floating plate 370 is rotated with respect to the valve body 346, a distance between the flow-in port 352*b* and one of the grooves 377*b* (which is nearest to the flow-in port 352*b*) may not be largely changed. As a result, the fuel pressure increase in the lower side space 53*d* of the pressure control chamber 53 is stably controlled. In other words, it is possible to suppress variation of the response of the valve portion to the driving current, independently from the relative position of the floating plate 370 to the valve body 346.

Fourth and Fifth Embodiments

A fourth and a fifth embodiment of the present invention will be explained with reference to FIGS. 15 and 16, each of which is a modification of the third embodiment. Hereinafter, a floating plate 470 and 570 of each embodiment will be explained.

Figure 15A:
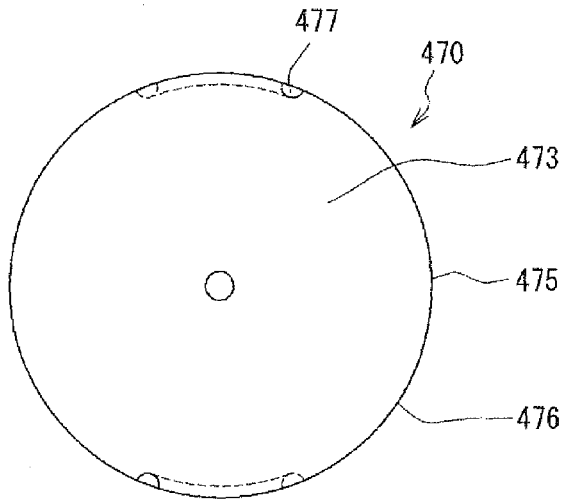
Figure 15B:
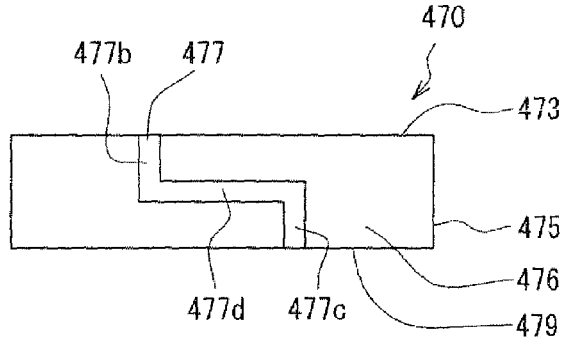

As shown in FIGS. 15A and 15B, according to the fourth embodiment, a side wall portion 476 and multiple passage wall portions 477 are formed at an outer side wall 475 of the floating plate 470. The passage wall portions 477 are formed at the outer peripheral surface of the side wall portion 476 by cutting away portions thereof. According to the fourth embodiment, the passage wall portions 477 form multiple grooves (477*b* to 477*d*) at the outer peripheral surface of the side wall portion 476, each of which is opened at one end to an upper side of the floating plate 470 (that is, the side of the press-contacting surface 473) and at its other end to a lower side 479 of the floating plate 470 (that is, the pressure receiving surface). The grooves are composed of vertical grooves 477*b* and 477*c* extending in the axial direction of the floating plate 470 and a lateral groove 477*b* extending in a circumferential direction of the floating plate 470. Each of the vertical grooves 477*b* and 477*c* is opened to the upper and lower side surfaces (473 and 479) of the floating plate 470. The vertical grooves 477*b* and 477*c* are displaced from each other in the circumferential direction by a length of the circumferential groove 477*d* connecting the vertical grooves 477*b* and 477*c* with each other.

Figure 16A:
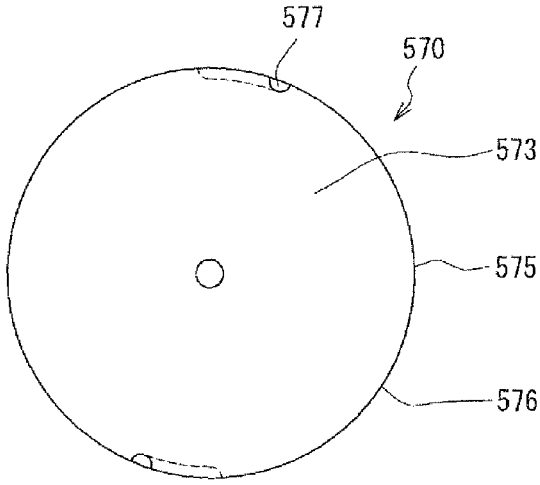
Figure 16B:
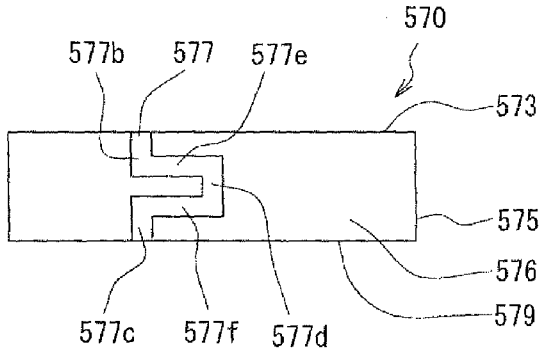

As shown in FIGS. 16A and 16B, according to the fifth embodiment, a side wall portion 576 and multiple passage wall portions 577 are formed at an outer side wall 575 of the floating plate 570. The passage wall portions 577 are formed at the outer peripheral surface of the side wall portion 576 by cutting away portions thereof. According to the fifth embodiment, the passage wall portions 577 form multiple grooves (577*b* to 577*f*) at the outer peripheral surface of the side wall portion 576, each of which is opened at one end to an upper side of the floating plate 570 (that is, the side of a press-contacting surface 573) and at its other end to a lower side 579 of the floating plate 570 (that is, the pressure receiving surface). The grooves are composed of vertical grooves 577*b*, 577*c* and 577*d* extending in the axial direction of the floating plate 570 and lateral grooves 577*e* and 577*f* extending in a circumferential direction of the floating plate 570. Each of the vertical grooves 577*b* and 577*c* is opened to the upper and lower side surfaces (573 and 579) of the floating plate 570, and arranged at positions which are overlapped in the axial direction of the floating plate 570. The vertical grooves 577*b* and 577*c* are displaced from the vertical grove 577*d* in the circumferential direction of the floating plate 570. The vertical grooves 577*b* and 577*d* are connected with each other by the lateral groove 577*e*, while the vertical grooves 577*c* and 577*d* are connected with each other by the lateral groove 577*f*.

As understood from the fourth and fifth embodiments, the shapes of the grooves formed by the passage wall portions 477 and 577 are not limited to the shape (the spiral grooves) of the third embodiment. According to the fourth and fifth embodiments, projected areas of the grooves 477 and 577 in the axial direction of the floating plate 470 and 570 can be a part of the pressure receiving surface. Therefore, it is possible with the grooves 477 or 577 to suppress the decrease of the pressure receiving surface. Accordingly, the pressing force of the press-contacting surface 473 or 573 to the pressure control surface of the valve body can be maintained at a high value for the floating plate 470 or 570 having the passage wall portions 477 or 577.

Sixth and Seventh Embodiments

A sixth and a seventh embodiment of the present invention will be explained with reference to FIGS. 17 and 18, each of which is a further modification of the third embodiment. Hereinafter, a floating plate 670 and 770 as well as a valve body 646 or 746 of each embodiment will be explained.

Figure 17:
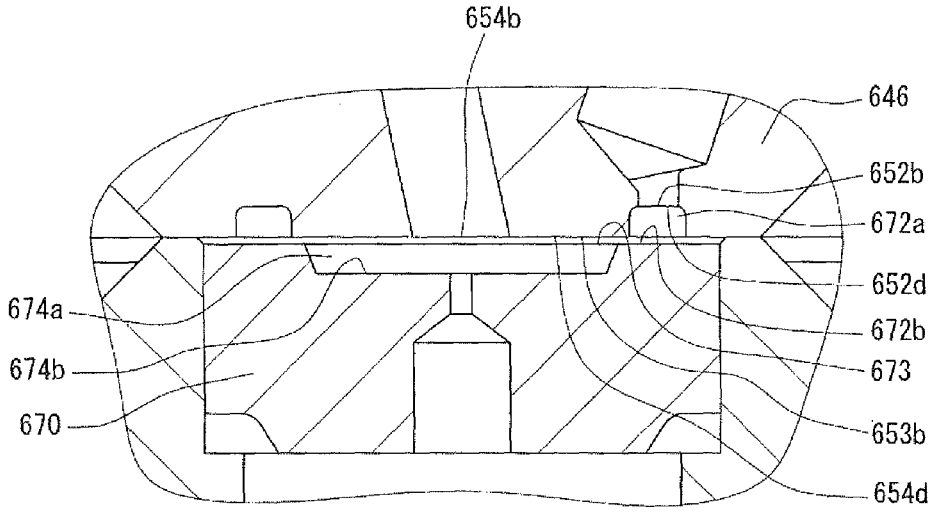
FIG. 17 is an enlarged cross sectional view showing a characterizing portion of the fuel injection device according to a sixth embodiment of the present invention, which corresponds to a modification of the fuel injection device shown in FIG. 13.

As shown in FIG. 17, according to the sixth embodiment, a flow-in recessed portion 672*a* of an annular shape is formed at a pressure control surface 653*b* (of a circular shape) of the valve body 646. The flow-in recessed portion 672*a* is formed by depressing a part of the pressure control surface 653*b* in an upward direction away from a press-contacting surface 673 of the floating plate 670. A flow-in port 652*b* is opened at a bottom surface 652*d* of the flow-in recessed portion 672*a*. A flow-out-port surrounding surface 654*d*, which is a flat surface portion of the pressure control surface 653*b* surrounding a flow-out port 654*b*, is formed at an inner side of the flow-in recessed portion 672*a*.

According to the sixth embodiment, a flow-out recessed portion 674*a* is formed at a press-contacting surface 673 (which is an upper side surface of the floating plate 670). A bottom surface 674*b* of the flow-out recessed portion 674*a* is opposed to the flow-out-port surrounding surface 654*d* of the pressure control surface 653*b*. The flow-out recessed portion 674*a* is formed by depressing a part of the press-contacting surface 673 in a downward direction away from the pressure control surface 653*b*. The flow-out recessed portion 674*a* is formed at a center of the press-contacting surface 673 of a circular shape. In other words, the flow-out recessed portion 674*a* is a circular recess coaxial with the press-contacting surface 673. Furthermore, the flow-out recessed portion 674*a* is coaxial with the annular flow-in recessed portion 672*a* formed in the valve body 646. An outer peripheral portion 672*b* of the press-contacting surface 673, which is formed at an outer side of the flow-out recessed portion 674*a* and is opposed to the flow-in recessed portion 672*a*, is formed in an annular flat surface.

Figure 18:
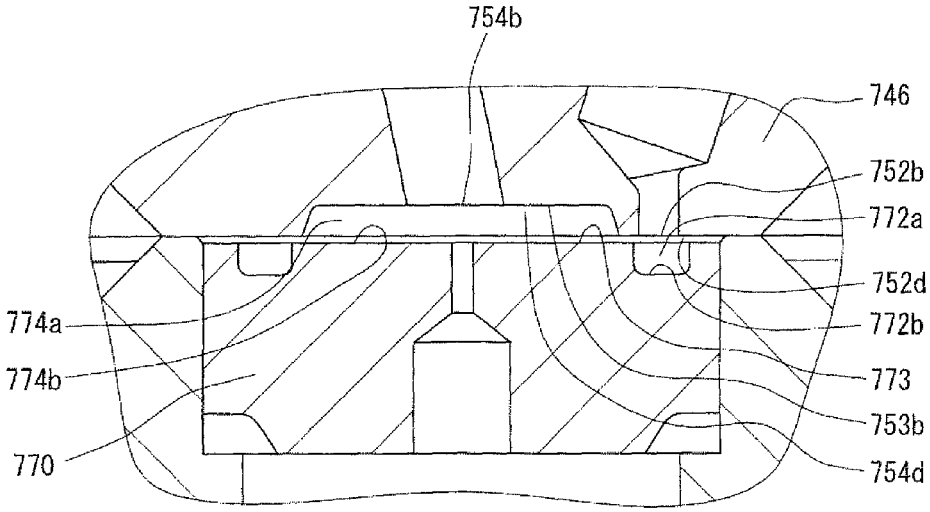
FIG. 18 is an enlarged cross sectional view showing a characterizing portion of the fuel injection device according to a seventh embodiment of the present invention, which corresponds to another modification of the fuel injection device shown in FIG. 13.

As shown in FIG. 18, according to the seventh embodiment, a flow-out recessed portion 774*a* of a circular shape is formed at a pressure control surface 753*b* (of a circular shape) of the valve body 746. The flow-out recessed portion 774*a* is formed by depressing a part of the pressure control surface 753*b* in an upward direction away from a press-contacting surface 773 of the floating plate 770. A flow-out port 754*b* is opened at a bottom surface 754*d* of the flow-out recessed portion 774*a*. The flow-out recessed portion 774*a* is surrounded by a circular flow-in-port surrounding surface 752*d*, which is a remaining part of the pressure control surface 753*b*. The flow-out recessed portion 774*a* is formed at a center of the pressure control surface 753*b*. A flow-in port 752*b* is opened at the flow-in-port surrounding surface 752*d*, which is formed in an annular flat surface.

A flow-in recessed portion 772*a* of an annular shape is formed at the press-contacting surface 773 of the floating plate 770. The flow-in recessed portion 772*a* is formed by depressing a part of the press-contacting surface 773 in a downward direction away from the pressure control surface 753*b*. The flow-in recessed portion 772*a* is coaxially formed with the press-contacting surface 773. A bottom surface 772*b* of the flow-in recessed portion 772*a* is opposed to the annular flow-in-port surrounding surface 752*d*. Furthermore, the flow-in recessed portion 772*a* is coaxial with the flow-out recessed portion 774*a* formed in the valve body 746. A portion 774*b* of the press-contacting surface 773, which is surrounded by the flow-in recessed portion 772*a* and opposed to the flow-out recessed portion 774*a*, is formed in a circular flat surface.

According to the sixth embodiment (FIG. 17), the flow-in recessed portion 672*a* is formed in the valve body 646, while the flow-out recessed portion 674*a* is formed in the floating plate 670. On the other hand, according to the seventh embodiment (FIG. 18), the flow-in recessed portion 772*a* is formed in the floating plate 770, while the flow-out recessed portion 774*a* is formed in the valve body 746. In the fuel injection device, in which the floating plate is provided in order to improve the response of the valve portion to the driving current, the press-contacting surface of the floating plate as well as the pressure control surface should have strength enough to withstand repeated press contacts thereof. However, the strength may be decreased when the flow-in or the flow-out recessed portion is formed. According to the above sixth or seventh embodiment, the flow-in recessed portion (672*a*, 772*a*) is formed in one of the press-contacting surface (673, 773) and the pressure control surface (653*b*, 753*b*), while the flow-out recessed portion (674*a*, 774*a*) is formed in the other of the press-contacting surface (673, 773) and the pressure control surface (653*b*, 753*b*). As a result, the sufficient strength for the press-contacting surface and the pressure control surface can be obtained, to thereby assure a stable operation (for example, the block-off of the communication between the flow-in port and the pressure control chamber) of the valve portion for a long period.

Eighth Embodiment

An eighth embodiment of the present invention will be explained with reference to FIG. 19, which is a modification of the first embodiment. Hereinafter, a floating plate 870 of the eighth embodiment will be explained.

Figure 19:
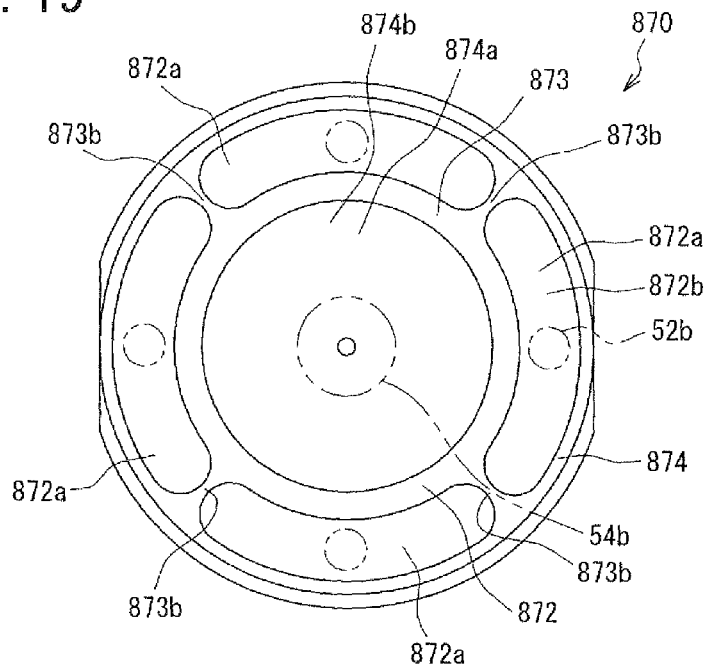
FIG. 19 is a cross sectional view showing a characterizing portion of the fuel injection device (a pressure control surface of a valve body) according to an eighth embodiment of the present invention, which corresponds to a modification of the fuel injection device shown in FIG. 4.

FIG. 19, corresponding to FIG. 4, is a top plan view showing the floating plate 870. Multiple flow-in recessed portions 872*a* of an arc shape are formed by depressing respective parts of a press-contacting surface 873 in a downward direction away from the pressure control surface 53*b* (FIG. 5A) of the valve body. A bottom surface 872*b* of each flow-in recessed portion 872*a* is opposed to the respective flow-in port 52*b*. A flow-out recessed portion 874*a* is formed at the center of the floating plate 870 (the press-contacting surface 873), wherein a bottom surface 874*b* thereof is opposed to the flow-out port 54*b*. The multiple flow-in recessed portions 872*a* form an annular shape as a whole and arranged at an outer side of the flow-out recessed portion 874*b* so as to surround it. The flow-in recessed portions 872*a* are formed in the same shape to each other and arranged at equal distances in a circumferential direction.

At the upper side of the floating plate 870, an annular inside contacting portion 872 is formed between the flow-out recessed portion 874*a* and the flow-in recessed portions 872*a* and an annular outside contacting portion 874 is formed at an outer peripheral side of the flow-in recessed portions 872*a*, wherein each of the contacting portions 872 and 874 are operatively brought into contact with and pressed against the pressure control surface 53*b*. In addition, multiple partitioning portions 873*b* are formed at the upper side of the floating plate 870 so as to separate the flow-in recessed portions 872*a* from each other. Each of the partitioning portions 873*b* extends in a radial direction of the floating plate 870 from the annular inside contacting portion 872 to the annular outside contacting portion 874.

According to the eighth embodiment, multiple flow-in recessed portions 872*a* are formed. In addition, the annular inside and outside contacting portions 872 and 874 are connected with each other by the multiple partitioning portions 873*b*, so that the rigidity of the contacting portions 872 and 874 can be increased. In addition, the pressing force of the contacting portions 872 and 874 are equally applied to the pressure control surface 53*b*, so that the block-off operation of the floating plate 870 for the communication between the flow-in ports 52*b* and the pressure control chamber 53 (FIG. 5A) as well as the communication between the flow-in ports 52*b* and the flow-out port 54*b* can be surely carried out.

Ninth Embodiment

Figure 20:
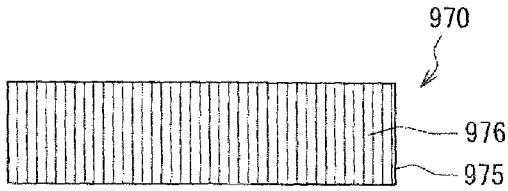
FIG. 20 is a side view showing a floating plate used in the fuel injection device according to a ninth embodiment of the present invention for explaining a characterizing portion thereof.

A ninth embodiment of the present invention will be explained with reference to FIG. 20, which is a further modification of the third embodiment.

A knurled surface 976 is formed at a side wall 975 of a floating plate 970. The knurled surface 976 is formed by multiple small grooves extending in the axial direction of the floating plate 970, wherein the small grooves are arranged at equal distances in a circumferential direction.

Figure 21:
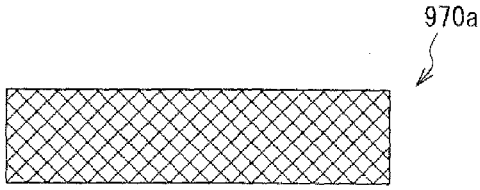
FIG. 21 is a side view showing a floating plate according to a modification of the floating plate shown in FIG. 20.

As shown in FIG. 21, a knurled surface may be alternatively formed at the side wall of a floating plate 970*a* in a striped shape, in which multiple small grooves are crossing with each other.

Tenth Embodiment

Figure 22:
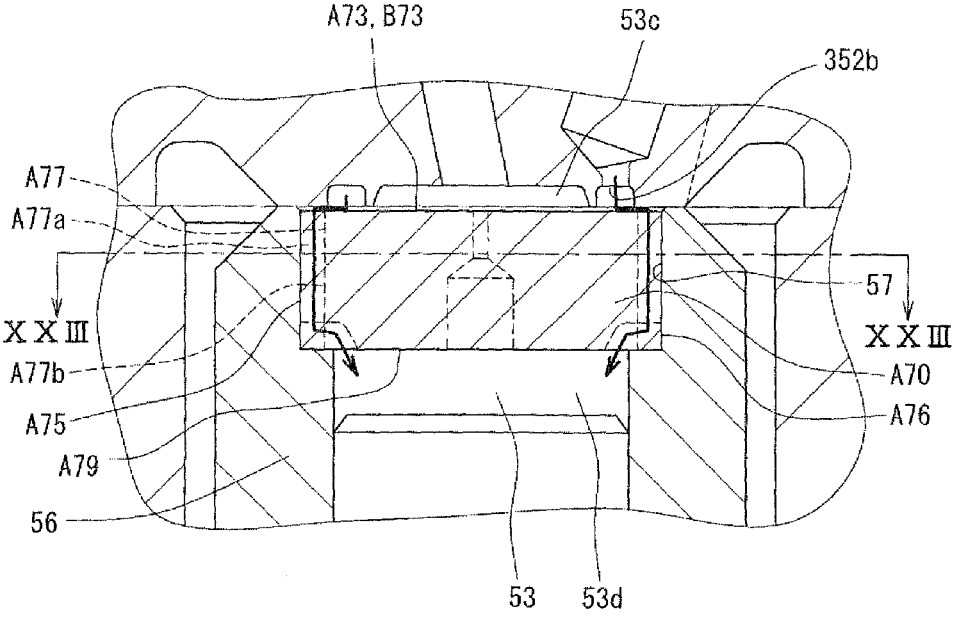
FIG. 22 is an enlarged cross sectional view showing a characterizing portion of the fuel injection device according to a tenth embodiment of the present invention.
Figure 23:
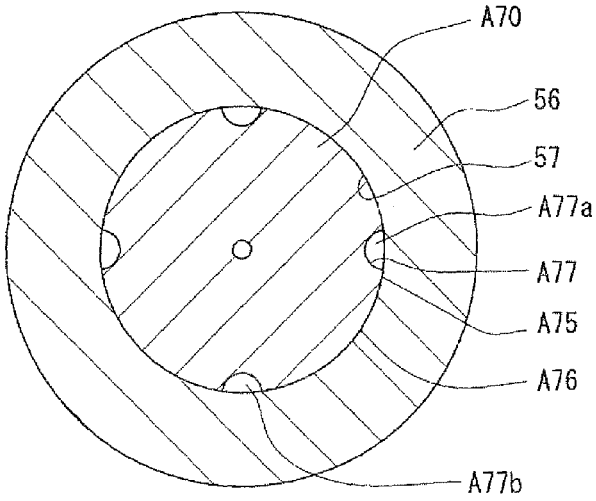
FIG. 23 is a cross sectional view taken along a line XXIII-XXIII in FIG. 22.

A tenth embodiment of the present invention will be explained with reference to FIGS. 22 and 23, which is a further modification of the third embodiment. Hereinafter, a floating plate A70 of the tenth embodiment will be explained.

A side wall portion A76 and multiple passage wall portions A77 are formed at an outer side wall A75 of the floating plate A70. Each of the passage wall portions A77 is formed by cutting away respective portions of the outer side wall A75. Each of the passage wall portions A77 forms a groove A77*b*, one of axial ends of which is opened at an upper side and the other axial end of which is opened at a lower side of the floating plate A70. Multiple (four) grooves A77*b* extend in an axial direction of the floating plate A70 and are arranged at equal distances in a circumferential direction of the floating plate A70. Multiple communication passages A77*a* are formed by the grooves A77*b* and the inner peripheral wall 57 of the cylinder 56, so that the fuel flows from the flow-in port 352*b* into the pressure control chamber 53 and further flows from the upper side space 53*c* to the lower side space 53*d* through the multiple communication passages A77*a*, as indicated by solid arrow lines in FIG. 22. A sum of the passage area for the communication passages A77*a* is made larger than the opening area of the flow-in port 352*b*.

As shown in the tenth embodiment, the communication passages A77*a* may be formed in the form of the straight grooves A77*b* extending in the axial direction of the floating plate A70. According to such grooves A77*b*, the fuel flow between the upper side space 53*c* and the lower side space 53*d* can be surely obtained.

Eleventh Embodiment

Figure 24:
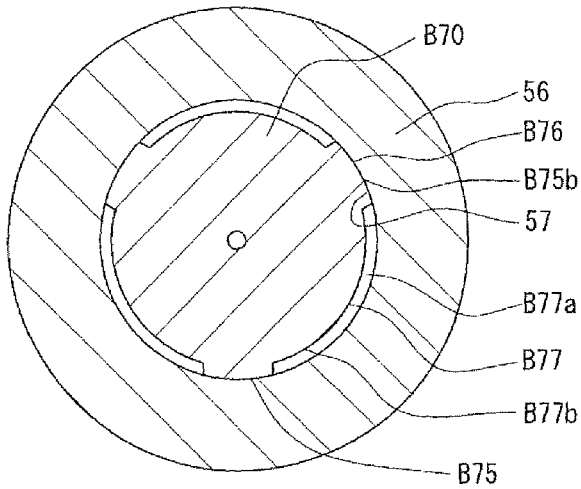
FIG. 24 is a cross sectional view showing the fuel injection device according to an eleventh embodiment of the present invention, which corresponds to a modification of the tenth embodiment shown in FIG. 23.

An eleventh embodiment of the present invention will be explained with reference to FIG. 24, which is a modification of the tenth embodiment. Hereinafter, a floating plate B70 of the eleventh embodiment will be explained.

Multiple side wall portions B76 and multiple passage wall portions B77 are formed at an outer side wall B75 of the floating plate B70. Each of the communication passage wall portions B77 is formed by cutting away respective portions of the outer wall B75. Each of the passage wall portions B77 forms a groove B77*b*, one of axial ends of which is opened at an upper side and the other axial end of which is opened at a lower side of the floating plate B70. The grooves B77*b* are arranged at equal distances in a circumferential direction of the floating plate B70, and each of the grooves B77*b* extends in an axial direction of the floating plate B70. In each of the grooves 377*b*, a circumferential length thereof is made larger than a depth of the groove B77*b* in a radial direction. More exactly, each of the grooves B77*b* has an arced shape and an angle of the arc with respect to a center of the floating plate B70 is around 90 degrees. Three side wall portions B76 between the grooves B77*b* are formed as sliding surface portions B75*b*. Each of the sliding surface portions B75*b* has an arced surface, an angle of which is around 30 degrees. The sliding surface portions B75*b* are in a sliding contact with the inner peripheral wall 57 of the cylinder 56, so that the floating plate 370 is coaxially accommodated in the cylinder 56. The groove B77*b* has a wider angle in the circumferential direction, so that sliding surface areas between the side wall portions B76 and the inner peripheral wall 57 are reduced to thereby achieve a smooth movement of the floating plate B70.

According to the eleventh embodiment, the depth of the groove 377*b* in the radial direction is made smaller, while the length of the groove B77*b* in the circumferential direction is made longer, in order that passage area of communication passages B77*a* formed by the grooves B77*b* is increased. With the grooves B77*b* having longer length in the circumferential direction, not only a sufficient amount of the passage area for the communication passages 377*a* is obtained, but also a necessary amount for a press-contacting surface (an upper surface of the floating plate 570, not shown in FIG. 24) is obtained. A design flexibility for the press-contacting surface can be thus increased.

Twelfth and Thirteenth Embodiments

A twelfth and a thirteenth embodiment of the present invention will be explained with reference to FIGS. 25 and 26, each of which is a modification of the eleventh embodiment. In each of a floating plate C70 of the twelfth embodiment (FIG. 25) and a floating plate 570 of the thirteenth embodiment (FIG. 26), a diameter of an upper side as well as a diameter of a lower side of the floating plate is made smaller than a maximum diameter of a middle portion of the floating plate.

Figure 25:
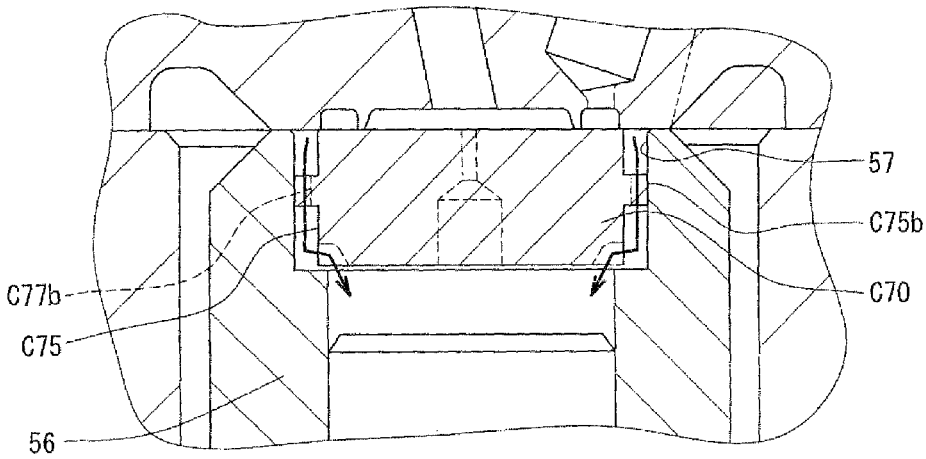
FIG. 25 is an enlarged cross sectional view showing a characterizing portion of the fuel injection device according to a twelfth embodiment of the present invention, which corresponds to a modification of the fuel injection device shown in FIG. 22.

More exactly, as shown in FIG. 25, stepped portions are formed at upper and lower sides of a side wall C75 of the floating plate C70. Each of diameters of the upper and lower sides is made smaller than a diameter of the middle portion of the floating plate C70.

In addition, multiple grooves C77*b* (similar to the grooves B77*b* of the eleventh embodiment, FIG. 24) are formed at the side wall C75 of the floating plate C70. Multiple sliding surface portions C75*b* are likewise formed between the neighboring grooves C77*b* in a circumferential direction of the floating plate C70. The sliding surface portions C75*b* are in a sliding contact with the inner peripheral wall 57 of the cylinder 56, so that the floating plate C70 is movably accommodated in the cylinder 56. A displacement of the floating plate C70 in the cylinder 56 in the radial direction is suppressed.

Figure 26:
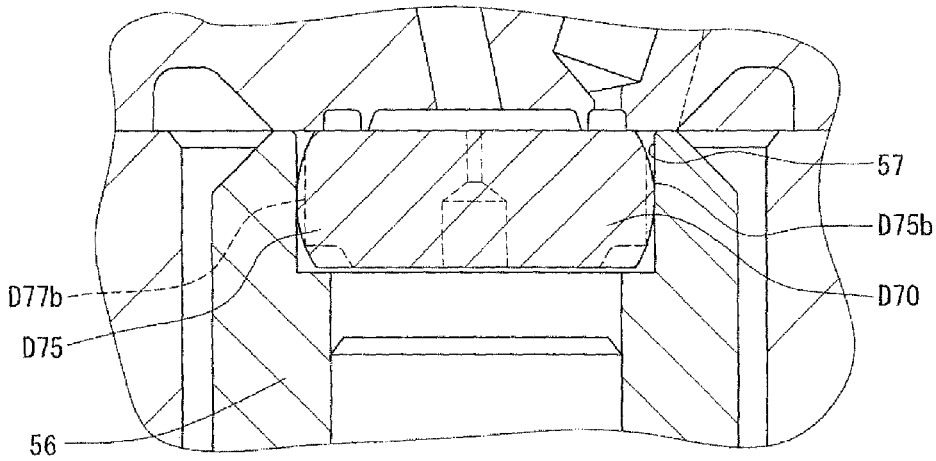
FIG. 26 is an enlarged cross sectional view showing a characterizing portion of the fuel injection device according to a thirteenth embodiment of the present invention, which corresponds to another modification of the fuel injection device shown in FIG. 22.

According to the floating plate D70 of the thirteenth embodiment, as shown in FIG. 26, a cross sectional configuration of a side wall D75 is curved, so that a middle portion is expanded in a radial and outward direction. Because of the curved configuration of the side wall D75, each of diameters of the upper and lower sides of the floating plate D70 is made smaller than a diameter of the middle portion.

In addition, multiple grooves D77*b* (similar to the grooves B77*b* of the eleventh embodiment, FIG. 24) are likewise formed at the side wall D75 of the floating plate D70. Multiple sliding surface portions D75*b* are likewise formed between the neighboring grooves D77*b* in a circumferential direction of the floating plate D70. The sliding surface portions D75*b* are in a sliding contact with the inner peripheral wall 57 of the cylinder 56, so that the floating plate D70 is movably accommodated in the cylinder 56. A displacement of the floating plate D70 in the cylinder 56 in the radial direction is suppressed.

In the twelfth or thirteenth embodiment, even when the floating plate C70 or D70 is inclined with respect to a longitudinal direction of the fuel injection device, an outer periphery of the upper or lower side of the floating plate may not be brought into contact with the inner peripheral wall 57 of the cylinder 56 due to the configuration of the floating plate C70 or D70. It is, therefore, possible to avoid such a situation that any of the outer periphery of the upper or lower side of the floating plate may be caught by the inner wall of the cylinder and firmly fixed to the inner wall. As a result, not only accuracy but also reliability for the fuel injection can be realized.

Other Embodiments

The present invention is explained with reference to several embodiments. However, the present invention should not be limited to those of the embodiments, but may be further modified in various ways without departing from the spirit of the invention.

In the above embodiments, the passage wall portion (77) is provided in the floating plate (70) to form the communication passage (77*a*) for connecting the upper side space (53*c*) and the lower side space (53*d*) of the pressure control chamber (53) with each other. The passage wall portion (77) is formed in the shape of the flat surfaces (77, 277), the grooves (377, 477, 577), the stripes or the like. The shape and the number of the passage wall portions are not limited to those explained in the above embodiments, so long as the communication passages (77*a*) are formed by the passage wall portions and the inner peripheral wall (57) of the cylinder (56) so that the fuel may flow through such communication passages (77*a*).

Figure 27A:
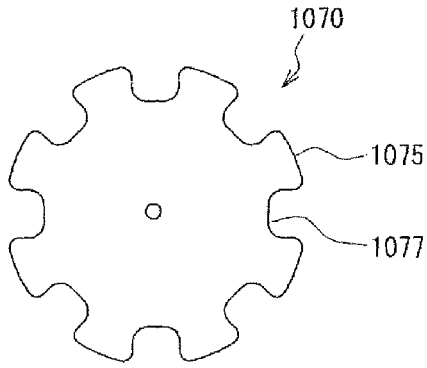
FIGS. 27A and 27B are plan views showing a floating plate according to further modifications of the present invention.
Figure 27B:
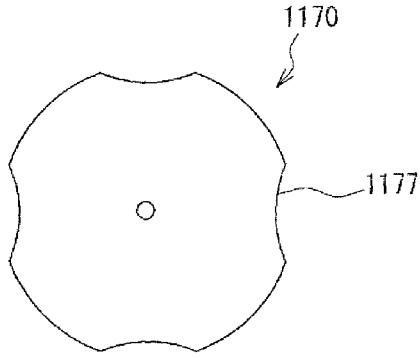

For example, as shown in FIG. 27A, multiple passage wall portions 1077 of a groove-shape may be formed at a side wall 1075 of a floating plate 1070, so that multiple communication passages are formed extending straightly in an axial direction of the floating plate 1070. Alternatively, as shown in FIG. 273, multiple passage wall portions 1177 of a shallow-dish-shape may be formed at a side wall of a floating plate 1170, wherein multiple communication passages extend straightly in an axial direction of the floating plate 1170.

In the above explained twelfth and thirteenth embodiments, the outer peripheral surface of the floating plate (C70, D70) is in the sliding contact with the inner peripheral wall (57) of the cylinder (56), so that the floating plate (C70, D70) is movable in the cylinder (56). However, at a maximum diameter portion of the floating plate (C70, D70), the gap between the outer peripheral surface of the floating plate (C70, D70) and the inner peripheral wall (57) of the cylinder (56) is negligible, so that substantially no fuel passes through such gap. In other words, the fuel passes only through the communication passages.

However, as a modification thereof, the maximum diameter portion of the floating plate may be reduced in its diameter, so that a gap is formed between the outer peripheral surface of the floating plate and the inner peripheral wall of the cylinder in order that a part of the fuel may pass through such enlarged gap.

In the above twelfth and thirteenth embodiments, the diameters of the upper and lower sides of the floating plate are made smaller. However, the diameter of either the upper or the lower side of the floating plate may be reduced.

According to the above modifications, the same effects to the twelfth or the thirteenth embodiment can be obtained. Namely, it is possible to avoid such a situation that any of the outer periphery of the upper or lower side of the floating plate may be caught by the inner wall of the cylinder and firmly fixed to the inner wall.

In the first embodiment, the inner and outer press-contacting portions 72 and 74 (the continuous projecting portions) are formed at the press-contacting surface 73 of the floating plate 70 and the pressure control surface 53*b* of the valve body 40 is formed of the flat surface. On the other hand, in the second embodiment, the flow-in-side and flow-out-side contacting portions 252*c* and 254*c* (the continuous projecting portions) are formed at the pressure control surface 253*b* of the valve body 246 and the press-contacting surface 273 is formed of the flat surface. As understood above, in the above first and second embodiments, the flow-in and flow-out recessed portions (72*a*, 74*a*, 272*a*, 274*a*) are formed either at the pressure control surface of the valve body or at the press-contacting surface of the floating plate.

In the sixth or seventh embodiment, one of the flow-in and the flow-out recessed portions is formed at one of the pressure control surface and the press-contacting surface, and the other of the flow-in and the flow-out recessed portion is formed at the other of the pressure control surface and the press-contacting surface.

It is not always necessary to form the flow-in (and flow-out) recessed portion at only one of the pressure control surface and the press-contacting surface. Namely, the flow-in (and flow-out) recessed portion may be formed at both of the pressure control surface and the press-contacting surface.

In the above embodiments, the flow-in port and the flow-out port are opened to the pressure control chamber at the same side of the floating plate. The relative position of the flow-in and the flow-out ports to the floating plate is not limited to the position of the above embodiments. The positions of the flow-in or the flow-out port may be changed, so long as the communication and non-communication (block-off of the communication) between the flow-in port and the pressure control chamber are carried out by the floating plate by use of the fuel pressure around the flow-out port.

In the above embodiments, the floating plate 70 is made in the cylindrical shape and the cross sectional shape of the side wall 75 is outwardly curved in the radial direction. In addition, the passage wall portions 77 are formed at the outer side wall 75 of the floating plate 70, wherein the passage wall portions 77 extend in the axial direction. The passage wall portions 77 may not be always necessary, if the gap between the outer side wall and the inner peripheral wall of the cylinder is enough large so that fuel can easily flows through the gap from the upper side space 53*c* to the lower side space 53*d*. Furthermore, the shape of the outer side wall of the floating plate may not be limited to that shown in the embodiment.

In the above embodiments, the driving portion for the pressure control valve 80, which controls fuel pressure in the pressure control chamber 53, is composed of the solenoid 31 and the movable member 35 driven by the magnetic force generated by the solenoid. The driving portion may be composed of another type actuator, for example, a piezo actuator, which drives the pressure control valve 80 in accordance with the control signal from the engine control unit 17.

In the above embodiments, the pressure control chamber is defined by the pressure control surface of the valve body, the inner peripheral wall of the cylinder, and the pressure receiving surface of the nozzle needle. The present invention may be also applied to the fuel injection device, which does not have an element corresponding to the cylinder, but in which the pressure control chamber is formed by the valve body and the nozzle needle.

In the above embodiments, the fuel injection device is applied to the diesel engine 20, in which the fuel is directly injected into combustion chambers 22 of the engine. The present invention may be also applied to the fuel injection device, which will be mounted in an internal combustion engine of an Otto-cycle engine. The fuel injected by the fuel injection device is not limited to the diesel oil, but other fuel such as, gasoline, liquefied petroleum gas, and so on) may be used. The fuel injection device may be further applied to an external combustion engine.

What is claimed is:

1. A fuel injection device comprising:

a nozzle body having an injection port and movably accommodating a valve member;

a valve portion provided in the nozzle body for opening and closing the injection port by movement of the valve member in accordance with a control signal from an engine control unit, so that a part of high pressure fuel from a fuel supply system is injected from the injection port and another part of the fuel is discharged into a fuel discharge passage, which is operatively connected to a fuel return line;

a pressure control chamber having a flow-in port, through which the high pressure fuel is supplied into the pressure control chamber, and a flow-out port, through which the fuel is discharged from the pressure control chamber to the fuel discharge passage, wherein the fuel pressure in the pressure control chamber is applied to the valve member so that the valve member is moved up or down depending on the fuel pressure in the pressure control chamber to thereby open or close the injection port;

a control body having a valve body, wherein the valve body has a pressure control surface exposed to the pressure control chamber, and the flow-in port and the flow-out port are opened at the pressure control surface;

a pressure control valve provided in the fuel discharge passage for changing its valve position in accordance with the control signal, so that the flow-out port is communicated with the fuel return line or the communication between the flow-out port and the fuel return line is blocked off;

a floating member movably accommodated in the pressure control chamber and having a press-contacting surface opposing to the pressure control surface in a moving direction of the floating member, the press-contacting surface being pressed against the pressure control surface in order to block off communication between the flow-in port and the pressure control chamber as well as communication between the flow-in port and the flow-out port when the pressure control valve is operated to bring the flow-out port into communication with the fuel return line;

a flow-out recessed portion formed at the pressure control surface or the press-contacting surface, so that a first space is formed on the side of the press-contacting surface as a part of the pressure control chamber when the press-contacting surface of the floating member is in contact with the pressure control surface, wherein the flow-out port is opened to the flow-out recessed portion; and a flow-in recessed portion formed at the pressure control surface or the press-contacting surface, so that the flow-in recessed portion is isolated from the pressure control chamber when the press-contacting surface of the floating member is in contact with the pressure control surface, wherein the flow-in port is opened to the flow-in recessed portion, wherein the flow-in recessed portion is recessed in a direction away from the pressure control surface or the press-contacting surface at which the flow-in recessed portion is not formed, wherein the flow-in recessed portion has a width in a radial direction of the floating member, which is larger than an inner diameter of the flow-in port, and wherein the flow-in recessed portion has a length in a circumferential direction of the floating member, which is larger than the inner diameter of the flow-in port.

2. The fuel injection device according to the claim 1, wherein the flow-in recessed portion is formed in an annular shape and coaxial with the pressure control surface or the press-contacting surface, at which the flow-in recessed portion is formed, and the flow-out recessed portion is formed at a surface portion of the pressure control surface or the press-contacting surface, at which the flow-out recessed portion is formed, the surface portion is located in an inside of flow-in recessed portion of the annular shape.

3. The fuel injection device according to the claim 1, wherein the pressure control surface of the valve body is formed of a circular shape, the flow-out recessed portion is formed at the pressure control surface at a position offset from a center of the pressure control surface, the flow-out recessed portion is surrounded by an annular flow-out-side contacting portion, the flow-in recessed portion is formed at the pressure control surface, the flow-in recessed portion is surrounded by a part of the annular flow-out-side contacting portion and a part of an annular flow-in-side contacting portion, and the other part of the annular flow-out-side contacting portion and the other part of the annular flow-in-side contacting portion are overlapped with each other.

4. The fuel injection device according to the claim 1, wherein a second space is formed on the other side of the floating member opposite to the press-contacting surface, wherein the second space is another part of the pressure control chamber, the floating member has a communication hole for communicating the first and second spaces with each other, so that the flow-out port is communicated with the second space even when the press-contacting surface of the floating member is in contact with the pressure control surface, and the floating member has a restricted portion in the communication hole.

5. The fuel injection device according to the claim 1, wherein the control body has a cylinder, one end of which surrounds the pressure control surface, and a cylindrical space of which forms the pressure control chamber so that the floating member is movable in the cylindrical space, the press-contacting surface is moved away from the pressure control surface when the pressure control valve is operated to block off the communication between the flow-out port and the fuel return line, a second space is formed on the other side of the floating member opposite to the press-contacting surface, as another part of the pressure control chamber, a side wall portion is formed at an outer side wall of the floating member, and a communication passage is formed at the side wall portion for communicating the first and second spaces of the pressure control chamber with each other.

6. A fuel injection device comprising:

a nozzle body having an injection port and movably accommodating a valve member;

a valve portion provided in the nozzle body for opening and closing the injection port by movement of the valve member in accordance with a control signal from an engine control unit, so that a part of high pressure fuel from a fuel supply system is injected from the injection port and another part of the fuel is discharged into a fuel discharge passage, which is operatively connected to a fuel return line;

a pressure control chamber having a flow-in port through which the high pressure fuel is supplied into the pressure control chamber, and a flow-out port through which the fuel is discharged from the pressure control chamber to the fuel discharge passage;

a control body having a valve body and a cylinder, wherein the valve body has a pressure control surface surrounded by one end of the cylinder and exposed to the pressure control chamber, wherein the flow-in port and the flow-out port are opened at the pressure control surface, wherein one end of the valve member is movably supported in a cylindrical space of the cylinder, wherein the pressure control chamber is defined by the pressure control surface, an inner peripheral wall of the cylinder and a pressure receiving surface formed at one end of the valve member, and wherein the fuel pressure in the pressure control chamber is applied to the pressure receiving surface of the valve member so that the valve member is moved up or down depending on the fuel pressure in the pressure control chamber to thereby open or close the injection port;

a pressure control valve provided in the fuel discharge passage for changing its valve position in accordance with the control signal, so that the flow-out port is communicated with the fuel return line or the communication between the flow-out port and the fuel return line is blocked off;

a floating member movably accommodated in the pressure control chamber and having a press-contacting surface opposing to the pressure control surface in a moving direction of the floating member, wherein the press-contacting surface is pressed against the pressure control surface in order to block off communication between the flow-in port and the pressure control chamber as well as communication between the flow-in port and the flow-out port when the pressure control valve is operated to bring the flow-out port into communication with the fuel return line, and wherein the press-contacting surface is moved away from the pressure control surface when the pressure control valve is operated to block off the communication between the flow-out port and the fuel return line;

a first space formed on a side of the press-contacting surface of the floating member, as a part of the pressure control chamber;

a second space formed on the other side of the floating member opposite to the press-contacting surface, as another part of the pressure control chamber;

a side wall portion formed at an outer side wall of the floating member; and a communication passage formed at the side wall portion for communicating the first and second spaces of the pressure control chamber with each other, wherein a part of the side wall portion is cut away to form the communication passage.

7. The fuel injection device according to the claim 5, wherein the side wall portion formed at the outer side wall of the floating member is in a sliding contact with the inner peripheral wall of the cylinder, so that the floating member is movable in the cylinder in its axial direction.

8. The fuel injection device according to the claim 5, wherein a passage area of the communication passage is larger than an opening area of the flow-in port.

9. The fuel injection device according to the claim 5, wherein multiple passage wall portions are formed at the side wall portion of the floating member, so that multiple communication passages are formed for communicating the first and second spaces of the pressure control chamber with each other.

10. The fuel injection device according to the claim 9, wherein the passage wall portion is formed of a flat surface extending in an axial direction of the floating member.

11. The fuel injection device according to the claim 9, wherein the passage wall portion is formed of a groove, one end of which is opened to the press-contacting surface of the floating member and the other end of which is opened to a side surface of the floating member opposite to the press-contacting surface.

12. The fuel injection device according to the claim 11, wherein a length of the groove in a circumferential direction of the floating member is made larger than a depth of the groove in a radial direction of the floating member.

13. The fuel injection device according to the claim 1, wherein the control body has a cylinder, one end of which surrounds the pressure control surface, and a cylindrical space of which forms the pressure control chamber so that the floating member is movable in the cylindrical space, the press-contacting surface is moved away from the pressure control surface when the pressure control valve is operated to block off the communication between the flow-out port and the fuel return line, a second space is formed on the other side of the floating member opposite to the press-contacting surface, as another part of the pressure control chamber, a side wall portion is formed at an outer side wail of the floating member, and a communication space is formed at a gap between the side wall portion and an inner peripheral wall of the cylinder for communicating the first and second spaces of the pressure control chamber with each other.

14. The fuel injection device according to the claim 1, wherein the floating member is formed in a disc shape and movable in the pressure control chamber in an axial direction of the disc shaped floating member, and a diameter of the floating member at the press-contacting surface or a surface of the floating member opposite to the press-contacting surface is made smaller than a diameter of the floating member at a middle portion thereof.

15. The fuel injection device according to the claim 5, wherein a side wall portion is formed at an outer side wall of the floating member, and the side wall portion has a cross sectional shape, which is outwardly expanded in a radial direction of the floating member.

16. The fuel injection device according to the claim 5, wherein a stopper portion is formed at an inner peripheral wall of the cylinder, so that a surface of the floating member opposite to the press-contacting surface is brought into contact with the stopper portion so as to limit a movement of the floating member, and a flow limiting groove is formed at the stopper portion or at the surface of the floating member opposite to the press-contacting surface, so that the fuel may flow though the flow limiting groove.

* * * * *